US011111658B2

(12) United States Patent
Miyake et al.

(10) Patent No.: US 11,111,658 B2
(45) Date of Patent: Sep. 7, 2021

(54) FLUSH TOILET

(71) Applicant: TOTO LTD., Kitakyushu (JP)

(72) Inventors: Tsubasa Miyake, Kitakyushu (JP); Hironori Yamasaki, Kitakyushu (JP); Mitsuhiro Suenaga, Kitakyushu (JP); Takashi Yoshioka, Kitakyushu (JP); Koichiro Hiwa, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 116 days.

(21) Appl. No.: 16/579,646

(22) Filed: Sep. 23, 2019

(65) Prior Publication Data

US 2020/0102728 A1 Apr. 2, 2020

(30) Foreign Application Priority Data

Sep. 28, 2018 (JP) ..... JP2018-184436
Sep. 28, 2018 (JP) ..... JP2018-184437
Sep. 28, 2018 (JP) ..... JP2018-184438
Sep. 28, 2018 (JP) ..... JP2018-184439

(51) Int. Cl.
*E03D 3/06* (2006.01)
*E03D 11/10* (2006.01)
*E03D 5/10* (2006.01)
*E03D 5/01* (2006.01)

(52) U.S. Cl.
CPC ..... *E03D 3/06* (2013.01); *E03D 5/10* (2013.01); *E03D 11/10* (2013.01); *E03D 5/01* (2013.01)

(58) Field of Classification Search
CPC ..... E03D 3/06; E03D 5/10; E03D 11/10
USPC ..... 4/431
See application file for complete search history.

(56) References Cited

U.S. PATENT DOCUMENTS

2009/0313750 A1 12/2009 Okubo et al.

FOREIGN PATENT DOCUMENTS

JP H05-230855 A 9/1993
JP 2000-145986 A 5/2000
JP 2001-123511 A 5/2001
JP 2010-156201 A 7/2010
(Continued)

OTHER PUBLICATIONS

An Office Action mailed by the Japanese Patent Office dated Aug. 3, 2020, which corresponds to Japanese Patent Application No. 2018-184436 and is related to U.S. Appl. No. 16/579,646; with English language translation.

(Continued)

*Primary Examiner* — Christine J Skubinna
(74) *Attorney, Agent, or Firm* — Studebaker & Brackett PC

(57) ABSTRACT

A flush toilet includes: a water supply channel that allows flush water to be supplied from a flush water storage tank to a rim spout port and a jet spout port; and a switching device that switches a water supply path so as to execute a first flushing process of spouting the flush water in the water supply channel from the rim spout port and after that, execute a second flushing process of spouting the flush water in the water supply channel from at least the jet spout port. The switching device includes a switching valve body that operates by receiving the water pressure of the flush water pressurized by a pressure pump. This switching valve body performs switching to a water supply path that allows the first flushing process or the second flushing process to be executed according to the water pressure generated by the pressure pump.

14 Claims, 7 Drawing Sheets

(56) References Cited

FOREIGN PATENT DOCUMENTS

| | | | |
|---|---|---|---|
| JP | 2012-140822 | A | 7/2012 |
| JP | 2017-066758 | A | 4/2017 |

OTHER PUBLICATIONS

An Office Action; "Notice of Reasons for Refusal," mailed by the Japanese Patent Office dated Dec. 10, 2020, which corresponds to Japanese Patent Application No. 2018-184436 and is related to U.S. Appl. No. 16/579,646 with English language translation.

FLUSH TOILET

BACKGROUND OF THE INVENTION

Field of the Invention

The present invention relates to a flush toilet and, more particularly, to a flush toilet that is flushed with pressurized flush water.

Description of the Related Art

Conventionally known flush toilets that are flushed with pressurized flush water are, for example, flush toilets described in Patent document 1 (Japanese Patent Unexamined Publication No. 2010-156201) and Patent document 2 (Japanese Patent Unexamined Publication No. 2017-66758).

First, in a conventional flush toilet described in Patent Literature 1, a bowl is flushed by so-called "hybrid flushing, " in which while rim spouting is executed by supplying tap water directly to a rim spout port and spouting it, jet spouting is executed by pressurizing the flush water stored in a tank by a pump and spouting it from a jet spout port.

In addition, in the above-mentioned conventional flush toilet described in the Patent Literature 1, a water supply path for rim spouting which is directly connected to tap water and a water supply path for jet spouting for supplying water to a tank that stores flush water for jet spouting can be switched with each other by an electric switching valve (such as an solenoid valve). The switching operation of this electric switching valve is performed with an electric signal under control of a controller. Therefore, when toilet flushing starts, rim spouting for spouting flush water from the rim spout port is first performed and then, jet spouting for spouting flush water from the jet spout port is performed while the rim spouting is continued.

Further, in a conventional flush toilet described in Patent Literature 2, flush water stored in a tank is pressurized by a pump and each of rim spouting and jet spouting is performed with only the flush water which has been pressurized by this pump. In addition, in this flush toilet, a spouting path of the flush water which has been pressurized by the pump is switchable to either a water supply path for rim spouting or a water supply path for jet spouting by an electric switching valve (such as a solenoid valve). The switching operation of this electric switching valve is performed with an electric signal under control of a controller.

Those conventional flush toilets described in Patent Literatures 1 and 2 can perform spouting by pressurizing the flush water stored in a tank with a pump even in a case where they are installed in a low water pressure area or location and therefore, can ensure toilet flushing performance.

However, the above-mentioned conventional flush toilet described in Patent Literature 1 has the problem that since it is necessary to install means, devices, etc. for supplying water to each of the water supply path for rim spouting by tap water direct pressure and the water supply path for jet spouting by pump pressurization, the number of parts increases accordingly and this causes the whole device size to increase.

Especially for the water supply path for rim spouting that supplies tap water directly to the rim spout port, it is preferable that the switching valve is arranged at a position higher than the rim spout port in consideration of a water head pressure (so-called head pressure). However, when the switching valve is arranged at a position higher than the rim spout port as described above, a space in the height direction of the flush toilet is required and this causes miniaturization of the device to be hindered.

Further, the above-mentioned conventional flush toilet described in Patent Literature 2 has a structure in which flush water pressurized by a common pump is supplied to the rim spout port and jet spout port; and this can suppress the height dimension of the flush toilet. However, in switching from the water supply path for rim spouting to the water supply path for jet spouting by the switching valve, it is necessary to switch from the water supply path for rim spouting to the water supply path for jet spouting when flush water is relatively highly pressurized by the pressure pump. Thus, there is a problem that in order to drive the electric switching valve (such as a solenoid valve) in a state where a relatively high water pressure is applied to the water supply path as described above, a relatively high torque is required and accordingly, the size of the switching valve increases.

Against this, torque required for the switching operation can be reduced by making the switching valve operate in advance in a state where a relatively low water pressure is applied. However, there is also a problem that if the rotation speed of the pump is increased when the switching valve is fully opened, wasteful water flow that does not contribute to the occurrence of siphonage may occur especially in jet spouting.

The present invention has been made in order to solve the problems in the above-mentioned prior arts, and it is an object of the present invention to provide a flush toilet that can mechanically and efficiently switch a water supply path, which supplies pressurized flush water to a rim spout port and jet spout port, by receiving the pressure of the flush water and thereby can achieve the miniaturization of a whole device.

SUMMARY OF THE INVENTION

To solve the above-mentioned problems, the present invention provides a flush toilet that is flushed with pressurized flush water. The flush toilet includes a flush water storage tank, a toilet main body, a water supply channel, a switching device, and a pressure pump. The flush water storage tank stores flush water. The toilet main body includes a bowl, a rim spout port and jet spout port configured to spout the flush water, and a discharge trap part. The water supply channel allows flush water to be supplied from the flush water storage tank to each of the rim spout port and the jet spout port. The switching device, which is provided on this water supply channel, switches a water supply path for supplying flush water to each of the rim spout port and the jet spout port. The switching device switches the water supply path so as to first execute a first flushing process for spouting the flush water in the water supply channel from the rim spout port and then, execute a second flushing process for spouting the flush water in the water supply channel from at least the jet spout port. The pressure pump pressurizes flush water that is to be supplied from the flush water storage tank to the water supply channel, thereby allowing the flow rate of the flush water in the water supply channel to be adjusted. The pressure pump allows such an adjustment that a second flow rate of flush water that is to be pressure-fed in the second flushing process becomes higher than a first flow rate of the flush water that is to be pressure-fed in the first flushing process. The switching device includes a switching valve body that mechanically operates by receiving the water pressure of the flush water which has been pressurized by the pressure pump. This switching valve body performs switching to a water supply path that allows the first flushing process or the second flushing process to be executed according to the water pressure which is generated by the pressure pump.

In the present invention thus configured, the switching valve body of the switching device can mechanically operate by receiving the water pressure of the flush water which has been pressurized by the pressure pump. This allows efficient switching of the water supply path to be performed according to the water pressure generated by the operation of the pressure pump: specifically, for example, efficient switching to the water supply path for executing a so-called "rim spouting" in the first flushing process for spouting from the rim spout port; and efficient switching to the water supply path for executing so-called "rim/jet spouting" in the second flushing process for spouting from at least the jet spout port.

For example, when the first flushing process (rim spouting) is switched to the second flushing process (rim/jet spouting) by the switching device, the water pressure in the water supply channel is adjusted to a relatively high water pressure by the operation of the pressure pump and the switching valve body that has received this relatively high water pressure can mechanically operate with good responsiveness so as to open the water supply path for executing the rim % jet spouting.

Thus, in jet spouting from the jet spout port, the occurrence of wasteful water flow, which does not contribute to the occurrence of siphonage in the bowl and discharge trap part of the toilet main body, can be suppressed.

In addition, when the second flushing process ends, the water pressure in the water supply channel is adjusted to a relatively low water pressure by the operation of the pressure pump and the switching valve body that has received this relatively low water pressure can mechanically operate with good responsiveness so as to close the water supply path for executing the rim/jet spouting. Therefore, the occurrence of wasteful water flow can be suppressed also after the second flushing process ends.

Further, the switching valve body of the switching device mechanically operates by receiving the water pressure of the flush water which has been pressurized by the pressure pump; and this eliminates the need for a motor, solenoid valve, or the like, which is electrically operated, for generating a relatively high torque in the switching device. Consequently, a device including the switching device, itself, can be miniaturized and also, the flexibility in installing the switching device can be improved. Thus, the whole flush toilet can also be miniaturized.

In the present invention, preferably, the switching device switches the water supply path so that the first flushing process is first executed so as to spout the flush water in the water supply channel from the rim spout port and after that, the second flushing process is executed so as to spout the flush water also from the jet spout port while continuing spouting the flush water from the rim spout port.

In the present invention thus configured, through switching of the water supply path by the switching device, the first flushing process is executed to execute rim spouting for spouting the flush water in the water supply channel from the rim spout port and after that, the second flushing process is executed to execute jet spouting for spouting the flush water in the water supply channel also from the jet spout port while continuing rim spouting, thereby allowing rim/jet spouting to be surely executed.

In addition, in the second flushing process, even when siphonage occurs in the bowl or discharge trap part of the toilet main body due to jet spouting, rim spouting is continued, thereby allowing odors to be suppressed from rising in the toilet main body.

In the present invention, preferably, the switching device includes: a rim water supply passage that is provided on an upstream side of the switching valve body and supplies flush water to the rim spout port; and a jet water supply passage that is provided on a downstream side of the switching valve body and supplies flush water to the jet spout port.

In the present invention thus configured, the switching device is configured so that the rim water supply passage is provided on the upstream side of the switching valve body and the jet water supply passage, which supplies flush water at a relatively high flow rate to the jet spout port, is provided on the downstream side of the switching valve body; and therefore, the flush water on the upstream side of the switching valve body of the switching device can be surely supplied to the rim water supply passage.

Consequently, in the second flushing process, etc., such a situation that flush water to be supplied to the rim water supply passage is drawn to the jet water supply passage on the downstream side of the switching device, causing the shortage of a supply amount to the rim water supply passage can be prevented.

Thus, the device including the switching device can be miniaturized while the flushing performance of the flush toilet is maintained and also, the whole flush toilet can be miniaturized.

In the present invention, preferably, the switching valve body of the switching device opens and closes only the jet water supply passage.

In the present invention thus configured, only the jet water supply passage is opened and closed by the switching valve body of the switching device and therefore, in each flushing process of the first flushing process and second flushing process, the rim water supply passage is always opened without being closed by the switching valve body of the switching device, allowing at least rim spouting to be performed.

In addition, a water supply path provided with the switching valve body of the switching device is limited to only the jet water supply passage and this can miniaturize the device including the switching device and also can miniaturize the whole flush toilet.

In the present invention, preferably, the switching valve body of the switching device is openably/closably provided at an upstream end of the jet water supply passage and is located above an upstream end of the rim water supply passage.

In the present invention thus configured, the upstream end of the jet water supply passage, which is opened and closed by the switching valve of the switching device, is located above the upstream end of the rim water supply passage. Therefore, in a state where the switching valve body closes the upstream end of the jet water supply passage, the flush water on the upstream side of the switching device can be discharged from the rim water supply passage below the switching valve body and on the upstream side of it, without being accumulated in the vicinity of the upstream end of the jet water supply passage, thereby allowing efficient draining.

This can suppress the adhesion of scale and the like to the switching valve body for a long time due to submersion of the switching valve body of the switching device all the time and accordingly, can prevent the malfunction and deterioration of the switching valve body.

In the present invention, preferably, the switching valve body of the switching device is located above an overflow water level within the flush water storage tank.

In the present invention thus configured, the switching valve body of the switching device is located above the overflow water level within the flush water storage tank and therefore, the switching valve body can be surely prevented from being submerged due to the flush water in the flush water storage tank, and thus the malfunction and deterioration of the switching valve body can be prevented.

In the present invention, preferably, the rim water supply passage is provided with a fixed flow valve.

In the present invention thus configured, especially in the second flushing process, the flush water in the water supply channel is pressure-fed at a relatively high flow rate by pressurization of the pressure pump and accordingly, the flush water with a relatively high flow rate flows also into the rim water supply passage which is not provided with the switching valve body of the switching device.

Thus, the flow rate of the flush water which is spouted from the rim spout port via the rim water supply passage (rim spouting) can be adjusted to a fixed flow rate by the fixed flow valve provided in the rim water supply passage and therefore, the outside water leakage such as splashing of the flush water, which is spouted into the bowl of the toilet main body, to the outside can be suppressed.

In the present invention, preferably, the switching device further includes a bias part that biases the switching valve body in a valve closing direction. The switching valve body operates in a valve opening direction against the biasing force of the bias part when in a state of receiving a predetermined or higher water pressure.

In the present invention thus configured, the switching device includes the bias part that biases the switching valve body in a valve closing direction and therefore, this switching valve body can operate in a valve opening direction against the biasing force of the bias part when in a state of receiving a predetermined or higher water pressure.

This allows the switching device to be miniaturized with a simple structure and accordingly, also allows the whole flush toilet to be miniaturized.

In the present invention, preferably, the switching device further switches the water supply path so as to execute a third flushing process for spouting flush water from the rim spout port after the second flushing process, in which the spouting of flush water from the rim spout port is continued from the second flushing process. The pressure pump allows adjustment to be made so that the third flow rate of the flush water which is pressure-fed in the third flushing process is made lower than the second flow rate of the flush water which is pressure-fed in the second flushing process.

In the present invention thus configured, the pressure pump allows such an adjustment that the third flow rate of flush water which is pressure-fed in the third flushing process becomes lower than the second flow rate of flush water which is pressure-fed in the second flushing process and therefore, when the third flushing process is executed after the second flushing process, the water pressure within the water supply channel is adjusted to a low pressure state and accordingly the water supply path in the second flushing process is closed, thereby allowing quick switching to a water supply path in the third flushing process.

Thus, the third flushing process can be executed with good responsiveness.

Next, the present invention provides a flush toilet that is flushed with pressurized flush water. The flush toilet includes a flush water storage tank, a toilet main body, a water supply channel, a switching device, and a pressure pump. The flush water storage tank stores flush water. The toilet main body includes a bowl, a rim spout port and jet spout port for spouting the flush water, and a discharge trap part. The water supply channel allows flush water to be supplied from the flush water storage tank to each of the rim spout port and the jet spout port. The switching device, which is provided on this water supply channel, switches a water supply path for supplying flush water to each of the rim spout port and the jet spout port. The switching device switches the water supply path so as to first execute a first flushing process for spouting the flush water in the water supply channel from the rim spout port and then, execute a second flushing process for spouting the flush water in the water supply channel from at least the jet spout port. The pressure pump pressurizes flush water that is to be supplied from the flush water storage tank to the water supply channel, thereby allowing the flow rate of the flush water in the water supply channel to be adjusted. The pressure pump allows such an adjustment that a second flow rate of flush water that is to be pressure-fed in the second flushing process becomes higher than a first flow rate of flush water that is to be pressure-fed in the first flushing process. The switching device includes: a switching valve body that mechanically operates in the same operating axial direction as a flow path axial direction by receiving the water pressure of the flush water which has been pressurized by the pressure pump and opens and closes a water supply path from the water supply channel to at least the jet spout port; a bias part that biases this switching valve body in an operating axial direction for valve closing; and a buffer part that moderates the operation in the operating axial direction of the switching valve body.

In the present invention, preferably, the buffer part causes a buffer force in a direction perpendicular to the operating axial direction of the switching valve body to act on the switching valve body.

In the present invention, preferably, the switching device further includes: a valve shaft that is provided so as to extend from the switching valve body in the operating axial direction; and a support part that supports the bias part and the buffer part, and supports the valve shaft via the buffer part slidably in the operating axial direction. The buffer part applies a sliding resistance when the valve shaft slides in the operating axial direction.

In the present invention, preferably, the buffer part includes an annular seal member that is held by the support part in a state where the valve shaft is inserted.

In the present invention, preferably, the switching device switches the water supply path so that the first flushing process is first executed with the switching valve body closed, so as to spout the flush water in the water supply channel from the rim spout port and after that, the second flushing process is executed with the switching valve opened, so as to spout the flush water also from the jet spout port while continuing spouting the flush water from the rim spout port. The switching device includes: a rim water supply passage that is provided on an upstream side of the switching valve body and supplies flush water to the rim spout port; and a jet water supply passage that is provided on a downstream side of the switching valve body and supplies flush water to the jet spout port.

In the present invention, preferably, the switching device further switches a water supply path so as to execute a third flushing process for spouting, with the switching valve closed again, flush water from the rim spout port continuously after the second flushing process.

Next, the present invention provides a flush toilet that is flushed with pressurized flush water. The flush toilet includes a flush water storage tank, a toilet main body, a water supply channel, a switching device, and a pressure pump. The flush water storage tank stores flush water. The toilet main body includes a bowl, a rim spout port and jet spout port for spouting the flush water, and a discharge trap part. The water supply channel allows flush water to be supplied from the flush water storage tank to each of the rim spout port and the jet spout port. The switching device, which is provided on this water supply channel, switches a water supply path for supplying flush water to each of the rim spout port and the jet spout port. The switching device switches the water supply path so as to first execute a first flushing process for spouting flush water in the water supply channel from the rim spout port and then, execute a second flushing process for spouting flush water in the water supply channel from the jet spout port while continuing spouting from the rim spout port. The pressure pump pressurizes flush water that is to be supplied from the flush water storage tank to the water supply channel, thereby allowing the flow rate of the flush water in the water supply channel to be adjusted. The pressure pump allows such an adjustment that a second flow rate of flush water that is to be pressure-fed in the second flushing process becomes higher than a first flow rate of flush water that is to be pressure-fed in the first flushing process. The switching device includes: a switching valve body that mechanically operates by receiving the water pressure of the flush water which has been pressurized by the pressure pump, and opens and closes a water supply path from the water supply channel to at least the jet spout port; a first flow path that is supplied with the flush water from the pressure pump and extends to the switching valve body; a second flow path that branches from a branch part in this first flow path so as to supply flush water to the rim spout port; and a third flow path that supplies flush water from the switching valve body to the jet spout port. A first flow path cross-sectional area (A1) of the first flow path on an upstream side of the branch part is different from a second flow path cross-sectional area (A2) of the first flow path on a downstream side of the branch part.

In the present invention, preferably, the second flow path cross-sectional area (A2) is larger than the first flow path cross-sectional area (A1).

In the present invention, preferably, a third flow path cross-sectional area (A3) of the third flow path is larger than the second flow path cross-sectional area (A2) of the first flow path.

In the present invention, preferably, the second flow path cross-sectional area (A2) of the first flow path is larger than a fourth flow path cross-sectional area (A4) of the second flow path.

In the present invention, preferably, the first flow path cross-sectional area (A1) of the first flow path is larger than the fourth flow path cross-sectional area (A4) of the second flow path.

In the present invention, preferably, the third flow path includes: a main flow path that extends laterally with respect to the second flow path; and a transition flow path that transitions from an upstream end, which is opened and closed by the switching valve body, to the main flow path. The upstream end of the transition flow path is located below an upper end of the main flow path.

In the present invention, preferably, a second flow path central axis that extends along the second flow path from the branch part intersects, at right angles or acute angles, with a first flow path central axis that extends from the branch part to a downstream side of the first flow path.

Next, the present invention provides a flush toilet that is flushed with pressurized flush water. The flush toilet includes a flush water storage tank, a toilet main body, a water supply channel, a switching device, and a pressure pump. The flush water storage tank stores flush water. The toilet main body includes a bowl, a rim spout port and jet spout port for spouting the flush water, and a discharge trap part. The water supply channel allows flush water to be supplied from the flush water storage tank to each of the rim spout port and the jet spout port. The switching device, which is provided on this water supply channel, switches a water supply path for supplying flush water to each of the rim spout port and the jet spout port. The switching device switches the water supply path so as to first execute a first flushing process for spouting the flush water in the water supply channel from the rim spout port and then, execute a second flushing process for spouting the flush water in the water supply channel from at least the jet spout port. The pressure pump pressurizes flush water that is to be supplied from the flush water storage tank to the water supply channel, thereby allowing the flow rate of the flush water in the water supply channel to be adjusted. The pressure pump allows such an adjustment that a second flow rate of flush water that is to be pressure-fed in the second flushing process becomes higher than a first flow rate of flush water that is to be pressure-fed in the first flushing process. The switching device includes: a switching valve body that mechanically operates by receiving the water pressure of the flush water which has been pressurized by the pressure pump, and opens and closes a water supply path from the water supply channel to at least the jet spout port; a first flow path that extends from the pressure pump to the switching valve body; a second flow path that branches from a branch part in the first flow path and extends to the rim spout port; and a third flow path that extends from the switching valve body to the jet spout port. The switching valve body is arranged at an opposing position on the axial direction of the first flow path.

In the present invention, preferably, a flow path cross-sectional area (A3) of the third flow path is larger than a flow path cross-sectional area (A2) of the first flow path.

In the present invention, preferably, the flow path cross-sectional area (A2) on the downstream side of the branch part in the first flow path is larger than the flow path cross-sectional area (A1) of the first flow path on the upstream side of the branch part.

In the present invention, preferably, the first flow path is cylindrically formed and the center of the switching valve body is located on a central axis of the first flow path.

In the present invention, preferably, the switching device switches the water supply path so that the first flushing process is first executed so as to spout the flush water in the water supply channel from the rim spout port and after that, the second flushing process is executed so as to spout the flush water also from the jet spout port while continuing spouting the flush water from the rim spout port. The branch part for branching from the first flow path to the second flow path is located on an upstream side of the switching valve body.

According to the flush toilet of the present invention, water supply paths for supplying pressurized flush water to the rim spout port and jet spout port can be mechanically efficiently switched by receiving the water pressure of the flush water, thereby allowing the miniaturization of a whole device.

DETAILED DESCRIPTION OF THE PREFERRED EMBODIMENTS

Next, a flush toilet according to one embodiment of the present invention will be described with reference to the attached drawings.

It should be noted that the term "flow rate" which is used in the expressions such as "the flow rate of the flush water" and "spout flow rate" in the present description means a volume change per hour [L/min] (also referred to as so-called "volume flow rate" or "instantaneous flow rate").

Figure 1:
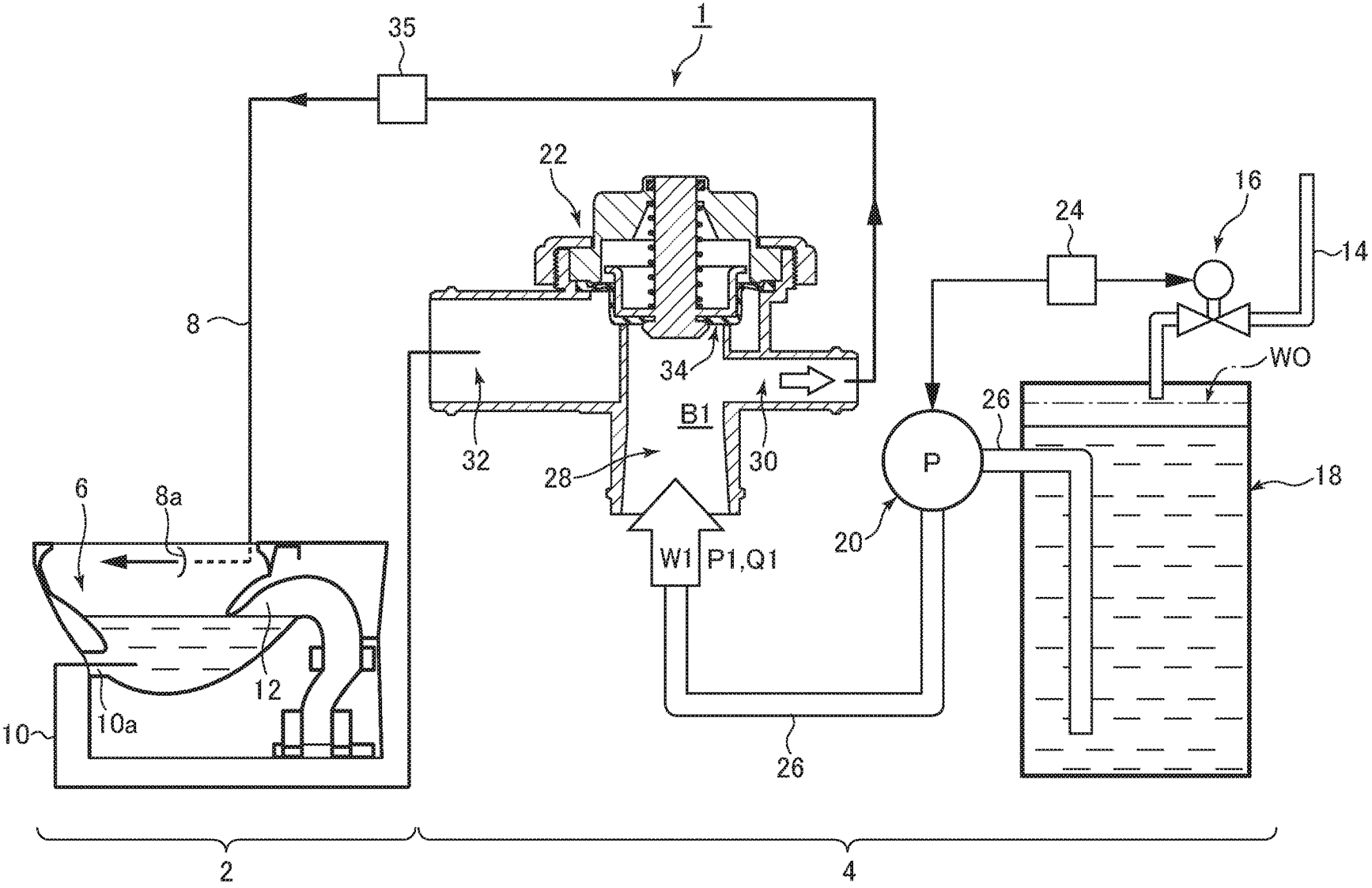
FIG. 1 is an entire schematic block diagram of a flush toilet according to one embodiment of the present invention.

FIG. 1 is an entire schematic block diagram of the flush toilet according to one embodiment of the present invention.

As shown in FIG. 1, a flush toilet 1 according to one embodiment of the present invention includes each of: a toilet main body 2 made of ceramic, etc.; and a function part 4 that is arranged behind this toilet main body 2.

The toilet main body 2 includes each of: a bowl 6; a rim water supply passage 8 including a rim spout port 8*a*; a jet water supply passage 10 including a jet spout port 10*a*; and a discharge trap conduit 12 (discharge trap part).

The function part 4 includes, from an upstream side toward a downstream side, a water supply pipe 14, a solenoid valve 16, a flush water storage tank 18, a pressure pump 20, and a switching valve device 22, etc.

The water supply pipe 14 has its upstream side directly connected to tap water. In addition, the solenoid valve 16 is provided on the way of the water supply pipe 14 on an upstream side of the flush water storage tank 18 and is opened and closed by control of a controller 24 (control part). Accordingly, the flush water in the water supply pipe 14 is supplied into the flush water storage tank 18 or is stopped from being supplied therewith.

In addition, the pressure pump 20 is provided on a water supply channel 26 that extends from the flush water storage tank 18 to its downstream side. For this pressure pump 20, a so-called "axial pump" or the like, which has a low head and is suitable for a high flow rate, is adopted; and a detailed description of its structure is omitted as it is a well-known art.

Further, the rotation speed N [rpm] of an impeller (not illustrated) of the pressure pump 20 can be adjusted by control of the controller 24.

In addition, the switching valve device 22 is provided on the water supply channel 26 on a downstream side of the pressure pump 20 and, though its detailed structure will be described later, is opened and closed by receiving the pressure of the flush water which has been pressurized by the pressure pump 20. This allows the switching valve device 22 to function as a switching device that switches a water supply path for supplying flush water to each of the rim spout port 8*a* and jet spout port 10*a* of the toilet main body 2.

Next, details of the switching valve device 22 will be described with reference to FIG. 1 to FIG. 3.

Figure 2:
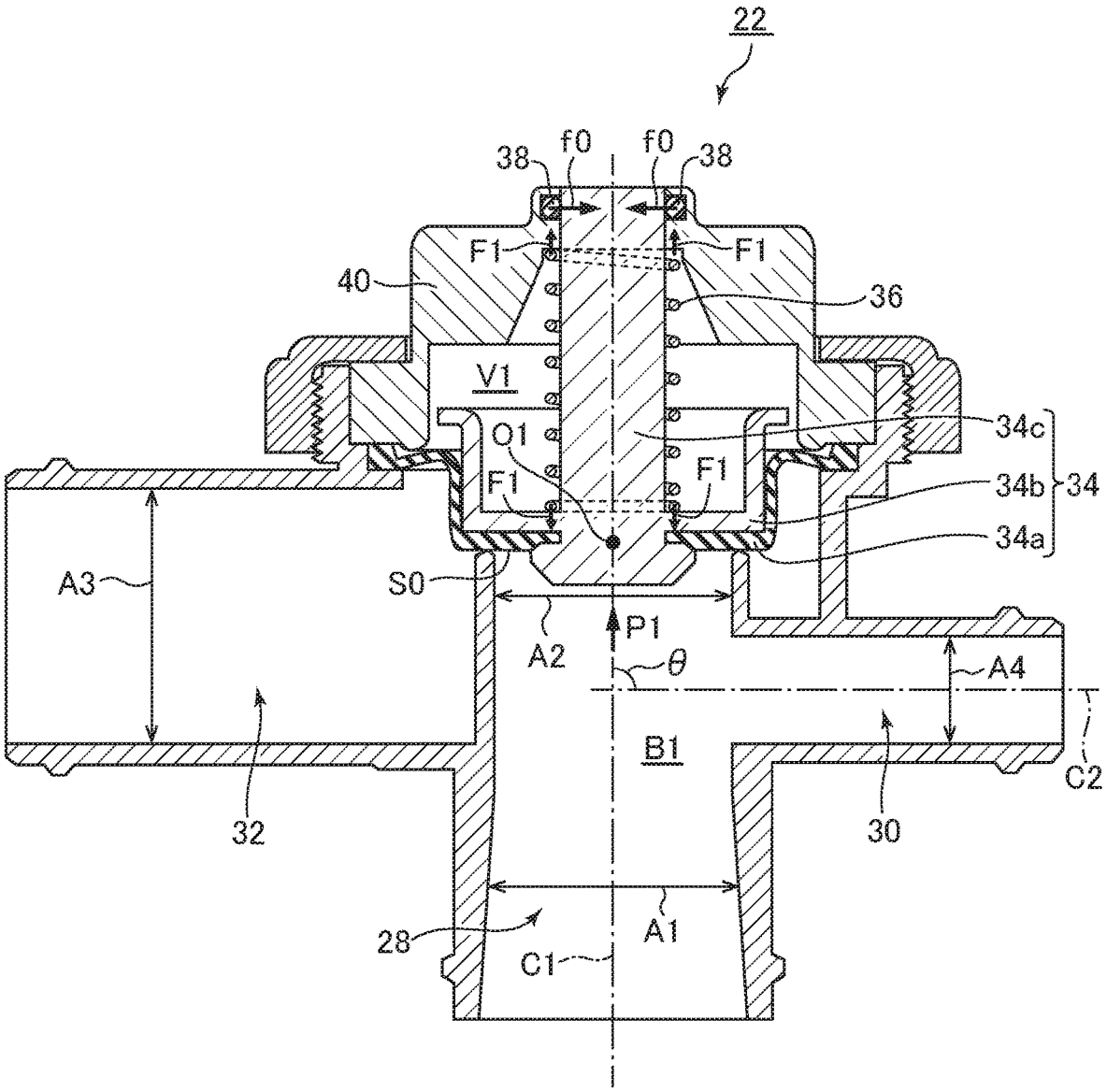
FIG. 2 is a longitudinal section view of a switching valve device of the flush toilet according to one embodiment of the present invention and shows a valve closed state.
Figure 3:
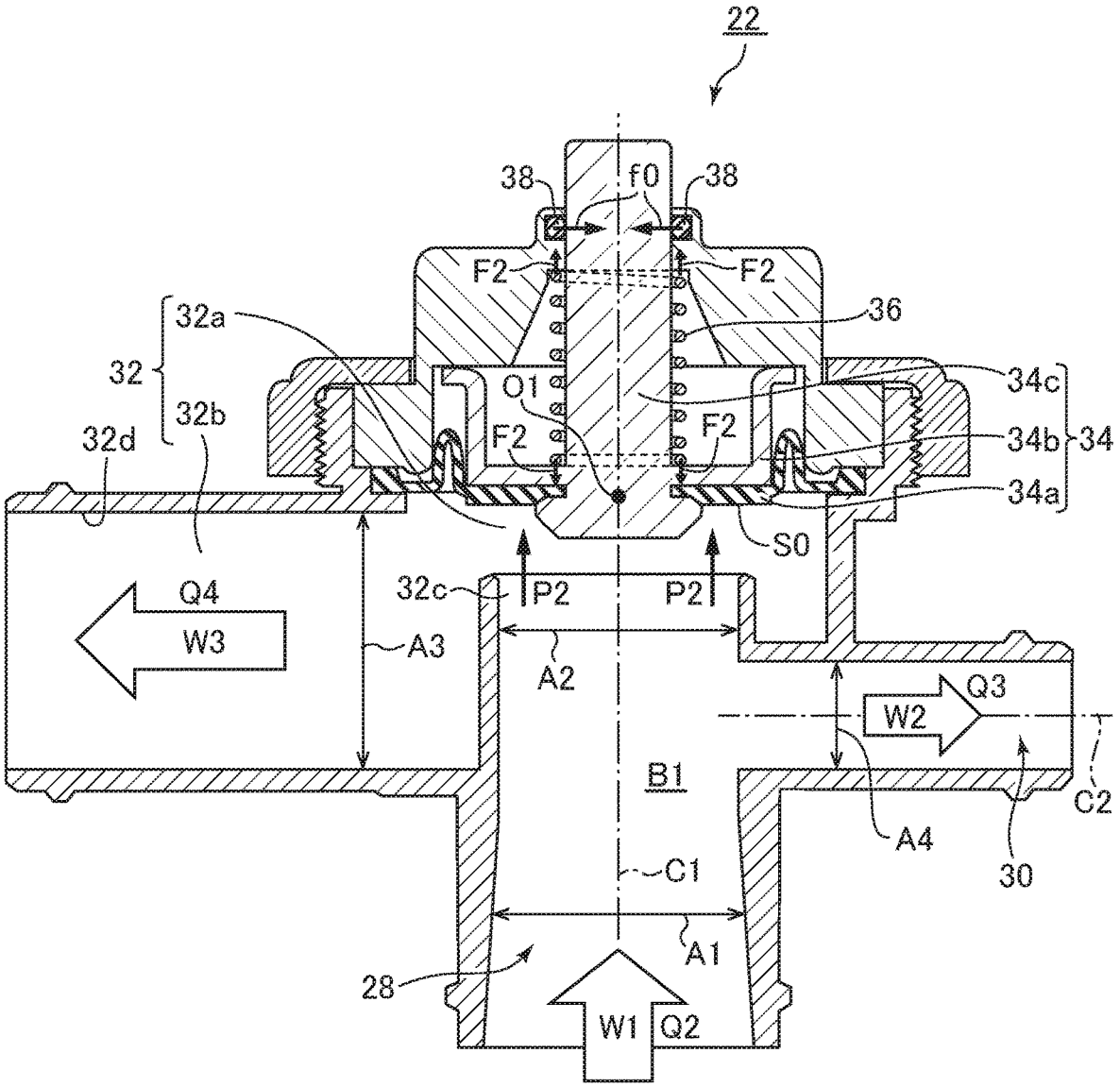
FIG. 3 is a longitudinal section view of the switching valve device of the flush toilet according to one embodiment of the present invention and shows a valve open state.

First, FIG. 2 is a longitudinal section view of the switching valve device of the flush toilet according to one embodiment of the present invention and shows a valve closed state; and FIG. 3 is a longitudinal section view of the switching valve device of the flush toilet according to one embodiment of the present invention and shows a valve open state.

As shown in FIG. 1 to FIG. 3, the switching valve device 22 includes: an upstream side water supply channel 28 (first flow path); a rim water supply channel 30 (second flow path), a jet water supply channel 32 (third flow path), and a switching valve body 34.

First, as shown in FIG. 1 to FIG. 3, the upstream side water supply channel 28 (first flow path) is connected to the water supply channel 26 extending from the pressure pump 20; and its downstream side extends upward in the vertical direction to the switching valve body 34. That is, the switching valve body 34 is arranged at an opposing position on the axial direction of the upstream side water supply channel 28 (first flow path).

Next, as shown in FIG. 1 to FIG. 3, the rim water supply channel 30 (second path) branches from a branch part B1 which is on the way of the upstream side water supply channel 28 located on an upstream side of the switching valve body 34; and its downstream side is connected to the rim water supply passage 8 on an upstream side of the rim spout port 8*a* of the toilet main body 2.

In addition, as shown in FIG. 1 to FIG. 3, in the jet water supply channel 32 (third flow path), a flow region on a downstream side of an upstream end (upper end and also downstream end of the upstream side water supply channel 28), which is opened and closed by the switching valve body 34, extends laterally. Further, a downstream side of the jet water supply channel 32 (third flow path) is connected to the jet water supply passage 10 on an upstream side of the jet spout port 10*a* of the toilet main body 2.

In addition, as shown in FIG. 1, on the way of either one of the rim water supply channel 30 of the switching valve device 22 and the rim water supply passage 8 of the toilet main body 2, a fixed flow valve 35 is provided.

This can suppress the outside water leakage such as splashing to the outside in rim spouting for spouting from the rim spout port 8*a* into the bowl 6 through the rim water supply passage 8 of the toilet main body 2.

It should be noted that in the present embodiment, the fixed flow valve 35 is provided in the rim water supply passage 8; however, a fixed flow function may be imparted to the switching valve device 22.

In addition, as shown in FIG. 1 to FIG. 3, the switching valve body 34 is openably/closably provided only at an upstream end of the jet water supply channel 32 and is located above an upstream end of the rim water supply channel 30 which is located at the branch part B1 of the upstream side water supply channel 28. This makes the switching valve body 34 opened and closed only for the jet water supply channel 32 (third path) while keeping the rim water supply channel 30 in an always open state.

Especially, in a state where the switching valve body 34 is closed as shown in FIG. 1 and FIG. 2, all the flush water in the upstream side water supply channel 28 is supplied from the branch part B1 to the rim spout port 8*a* via the rim water supply channel 30 (second flow path) and the rim water supply passage 8 on the toilet main body 2 side.

On the other hand, in a state where the switching valve body 34 is open as shown in FIG. 3, part of the flush water in the upstream side water supply channel 28 is supplied from the branch part B1 to the rim spout port 8*a* via the rim water supply channel 30 (second flow path) and the rim water supply passage 8 on the toilet main body 2 side; and also, most of or more than the most of the flush water in the upstream side water supply channel 28 is supplied from the branch part B1 to the jet spout port 10*a* via the jet water supply channel 32 (third flow path) and the jet water supply passage 10 on the toilet main body 2 side.

In addition, as shown in FIG. 2 and FIG. 3, the switching valve body 34 includes: a diaphragm-type valve body 34*a*; a support part 34*b* that supports this valve body 34*a*; and a valve shaft 34*c* that extends in an axial direction (operating axial direction) perpendicular to the valve body 34*a* and support part 34*b*.

The valve body 34*a* is arranged at an opposing position on a central axis C1 direction (flow path axial direction) of the upstream side water supply channel 28 that extends in the vertical direction.

This allows the switching valve body 34 to start a valve opening operation from a closed state when a lower surface (pressure receiving surface S0) of the valve body 34*a* receives the water pressure of the flush water in the upstream side water supply channel 28 which has been pressurized by the pressure pump 20.

Here, it is assumed that the water pressure in the state where the switching valve body 34 starts a valve opening operation from a closed state when the lower surface (pressure receiving surface S0) of the valve body 34*a* receives the water pressure of the flush water in the upstream side water supply channel 28 which has been pressurized by the pressure pump 20 is "boundary water pressure P0 [kPa]." When the lower surface (pressure receiving surface S0) of the valve body 34*a* receives a predetermined or higher water pressure of the flush water in the upstream side water supply channel 28 which has been pressurized by the pressure pump 20, the switching valve body 34 (34*a*, 34*b*, 34*c*) can mechanically operate in the same direction (axial direction of the valve shaft 34*c* (operating axial direction)) as the flow path axial direction of the upstream side water supply channel 28. This allows the upstream end of the jet water supply channel 32 to be opened and closed by the valve body 34*a* according to the water pressure.

It should be noted that in the present embodiment. "the switching valve body 34 mechanically operates" means that the switching valve body 34 is different from an electric valve body which electrically operates (is electrically opened and closed) by control with electric signals, an electromagnetic force, or the like, and means that the switching valve body 34 is a mechanical valve body which mechanically operates (is mechanically opened and closed) by being pressed due to the direct action of water pressure, etc. at the time of opening and closing.

Next, as shown in FIG. 2, the upstream side water supply channel 28 (first flow path) is formed in an approximately cylindrical shape and the center O1 of the valve body 34*a* of the switching valve body 34 is located on a central axis C1 of the upstream side water supply channel 28 (first flow path central axis).

This allows the water pressure (static pressure) P1 of the flush water in the upstream side water supply channel 28 in a valve closed state shown in FIG. 2 and the water pressure (dynamic pressure) P2 of the flush water in the upstream side water supply channel 28 in a valve open state shown in FIG. 3 to act almost uniformly on a pressure receiving surface S0 of the valve body 34*a* in an entire circumferential direction. Thus, the operation of the switching valve body 34 in switching the water supply path can be more stabilized.

Next, as shown in FIG. 2 and FIG. 3, the switching valve device 22 further includes a compression coiled spring 36 (bias part), an annular seal member 38 (buffer part), and a support member 40 (support part).

The compression coiled spring 36 (bias part) has a lower end supported by the support part 34*b* of the switching valve body 34 and also has an upper end supported by the support member 40 (support part).

In addition, this compression coiled spring 36 (bias part) makes a biasing force for biasing in a valve closing direction act on the switching valve body 34 (34*a*, 34*b*, 34*c*) according to the amount of deformation due to compression.

For example, as shown in FIG. 2, when the water pressure (static pressure) P1 that is lower than the predetermined water pressure (boundary water pressure P0 [kPa]) acts on the pressure receiving surface S0 of the valve body 34*a* of the switching valve body 34 in a valve closed state, the biasing force F1 of the compression coiled spring 36 exceeds a fluid force corresponding to the water pressure (static pressure) P1 and therefore, the closed state of the switching valve body 34 is maintained.

In addition, when the water pressure (static pressure) P1 that is equal to or higher than the predetermined water pressure (boundary water pressure P0 [kPa]) acts on the pressure receiving surface S0 of the valve body 34*a* of the switching valve body 34 in a valve closed state, the valve body 34*a* of the switching valve body 34 rises, thereby being switched to a valve open state as shown in FIG. 3.

Further, as shown in FIG. 3, when the water pressure (dynamic pressure) P2 (≥P0) that is equal to or higher than the predetermined water pressure (boundary water pressure P0 [kPa]) acts on the pressure receiving surface S0 of the valve body 34*a* of the switching valve body 34 in a valve open state, a fluid force corresponding to the water pressure (dynamic pressure) P2 exceeds the biasing force F2 of the compression coiled spring 36 according to deformation due to compression and therefore the switching valve body 34 operates in a valve open direction against the biasing force F2 and the valve open state of the switching valve body 34 is maintained.

Next, as shown in FIG. 2 and FIG. 3, the annular seal member 38 (buffer part) is an O ring which has a circular cross section or an annular seal member such as X packing or Y packing which has a cross section other than the circular one.

This annular seal member 38 is held by the support member 40 while being mounted on the upper part of the outer peripheral surface of the valve shaft 34*c* of the switching valve body 34 by insertion of the valve shaft 34*c* of the switching valve body 34. Thus, the valve shaft 34*c* of the switching valve body 34 is supported so as to be slidable in the operating axial direction by the support member 40 via the annular seal member 38.

In addition, as shown in FIG. 2 and FIG. 3, the annular seal member 38 (buffer part) makes a buffer force f0 in a direction perpendicular to the operating axial direction of the switching valve body 34 act on the valve shaft 34*c* of the switching valve body 34.

Accordingly, the annular seal member 38 is in contact with the outer peripheral surface of the valve shaft 34*c* of the switching valve body 34 to such an extent that an internal space VI of the support member 40 is opened to the atmosphere. Thus, when the valve shaft 34*c* of the switching valve body 34 slides in the operating axial direction, the annular seal member 38 makes a dynamic friction force, etc. act on the valve shaft 34*c* of the switching valve body 34, thereby allowing a sliding resistance to be applied.

In addition, as shown in FIG. 1 to FIG. 3, each of the switching valve body 34 (34*a*, 34*b*, 34*c*), a compression coiled spring 36, an annular seal member 38, a support member 40 in the switching valve device 22 is located above an overflow water level WO in the flush water storage tank 18.

Therefore, even when flush water in the flush water storage tank 18 reaches the overflow water level, those members 34, 36, 38, and 40 can surely be prevented from being submerged and thus the malfunction and deterioration of the switching valve device 22 can be prevented.

Next, as shown in FIG. 2, a central axis C2 (second flow path central axis) that extends along the rim water supply channel 30 (second flow path) from the branch part B1 of the upstream side water supply channel 28 (first flow path) of the switching valve device 22 intersects with the central axis C1 (first flow path central axis) that extends from the branch part B1 toward a downstream side of the upstream side water supply channel 28 (first flow path) at an angle θ.

Here, the present embodiment is described by using an example in which the angle θ is set to 90 degrees (right angle) (θ=90°); however, the angle θ may be set to an angle (acute angle) that is greater than 0 degrees and less than 90 degrees (0°<θ<90°).

Therefore, as shown in FIG. 1 to FIG. 3, the flush water, which flows from the upstream side into the branch part B1 of the upstream side water supply channel 28 (first flow path), flows into the upstream side water supply channel 28 on a downstream side of the branch part B1 and also can easily branch and flow from the branch part B1 to the rim water supply channel (second flow path), too.

In addition, a vortex flow can be suppressed from occurring either in the vicinity of the branch part B1 for branching from the upstream side water supply channel 28 (first flow path) to the rim water supply channel 30 (second flow path) or in the upstream side water supply channel 28 and rim water supply channel 30 on the downstream side of the branch part.

Next, as shown in FIG. 3, the jet water supply channel 32 (third flow path) of the switching valve device 22 includes, from its upstream side toward its downstream side, each of a transition flow path 32*a* and a main flow path 32*b*.

First, the transition flow path 32*a* of the jet water supply channel 32 is a flow path that is formed for a transition from an upstream end 32*c* (downstream end of the upstream side water supply channel 28), which is opened and closed by the switching valve body 34, to the main flow path 32*b*.

In addition, the main flow path 32*b* of the jet water supply channel 32 is a flow path that is formed so as to extend laterally from the downstream end of the transition flow path 32*a*, that is, in a direction orthogonal to the central axis C1 extending in a vertical direction of the upstream side water supply channel 28 (first flow path).

Further, the upstream end 32*c* of the transition flow path 32*a* of the jet water supply channel 32 (downstream end of the upstream side water supply channel 28) is located below an upper end 32*d* of the main flow path 32*b*.

Thus, in a state where the switching valve body 34 is open as shown in FIG. 3, when flush water flows from a downstream end 32*c* of the upstream side water supply channel 28 (first flow path) into the transition flow path 32*a* of the jet water supply channel 32 (third flow path), a wide flow region can be secured between the upstream end 32*c* of the transition flow path 32*a* and the upper end 32*d* of the main flow path 32*b*.

Consequently, when the switching valve body 34 is open, the occurrence of a vortex flow in a flow from the upstream side water supply channel 28 (first flow path) into the jet water supply channel 32 (third flow path) can be effectively suppressed.

Here, as shown in FIG. 2 and FIG. 3, a first flow path cross-sectional area A1 on an upstream side of the branch part B1 in the upstream side water supply channel 28 (first flow path) of the switching valve device 22 is different from a second flow path cross-sectional area A2 on a downstream side of the branch part B1 in the upstream side water supply channel 28 (first flow path).

Here, in the present embodiment, the second flow path cross-sectional area A2 is set to be larger than the first flow path cross-sectional area A1 (A2>A1).

In addition, as shown in FIG. 2 and FIG. 3, a third flow path cross-sectional area A3 of the main flow path 32*b* of the jet water supply channel 32 (third flow path) of the switching valve device 22 is set to be larger than the second flow path cross-sectional area A2 on the downstream side of the branch part B1 in the upstream side water supply channel 28 (first flow path) (A3>A2).

Further, as shown in FIG. 2 and FIG. 3, the second flow path cross-sectional area A2 on the downstream side of the branch part B1 in the upstream side water supply channel 28 (first flow path) of the switching valve device 22 is set to be larger than a fourth flow path cross-sectional area A4 in the rim water supply channel 30 (second flow path) (A2>A4).

And further, as shown in FIG. 2 and FIG. 3, the first flow path cross-sectional area A1 on the upstream side of the branch part B1 in the upstream side water supply channel 28 (first flow path) of the switching valve device 22 is set to be larger than the fourth flow path cross-sectional area A4 in the rim water supply channel 30 (second flow path) (A1>A4).

Next, the operation (action) of the flush toilet 1 according to one embodiment of the present invention will be described with reference to FIG. 1 to FIG. 6.

Figure 4:
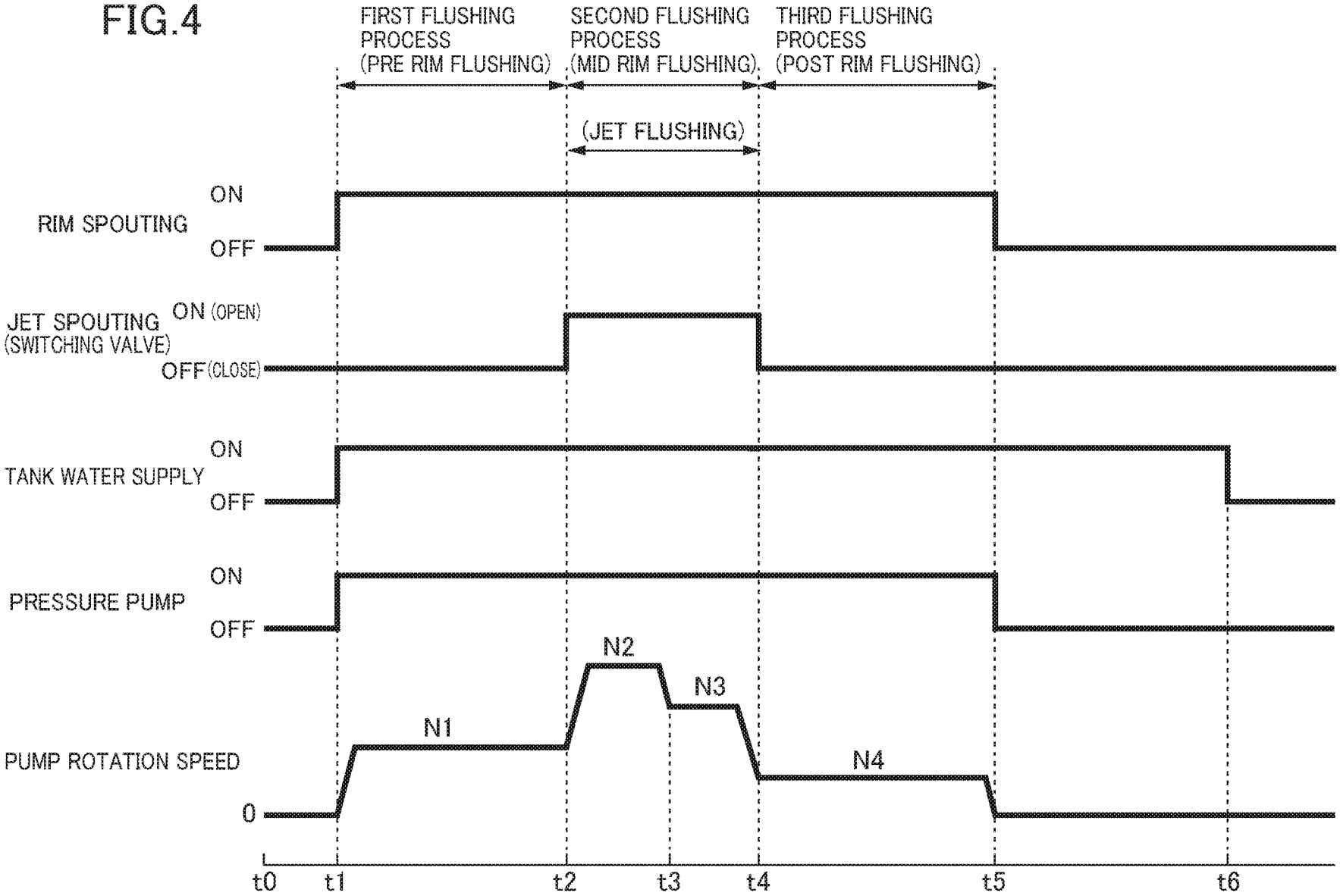
FIG. 4 is a time chart that shows the basic operation of the flush toilet according to one embodiment of the present invention.
Figure 5:
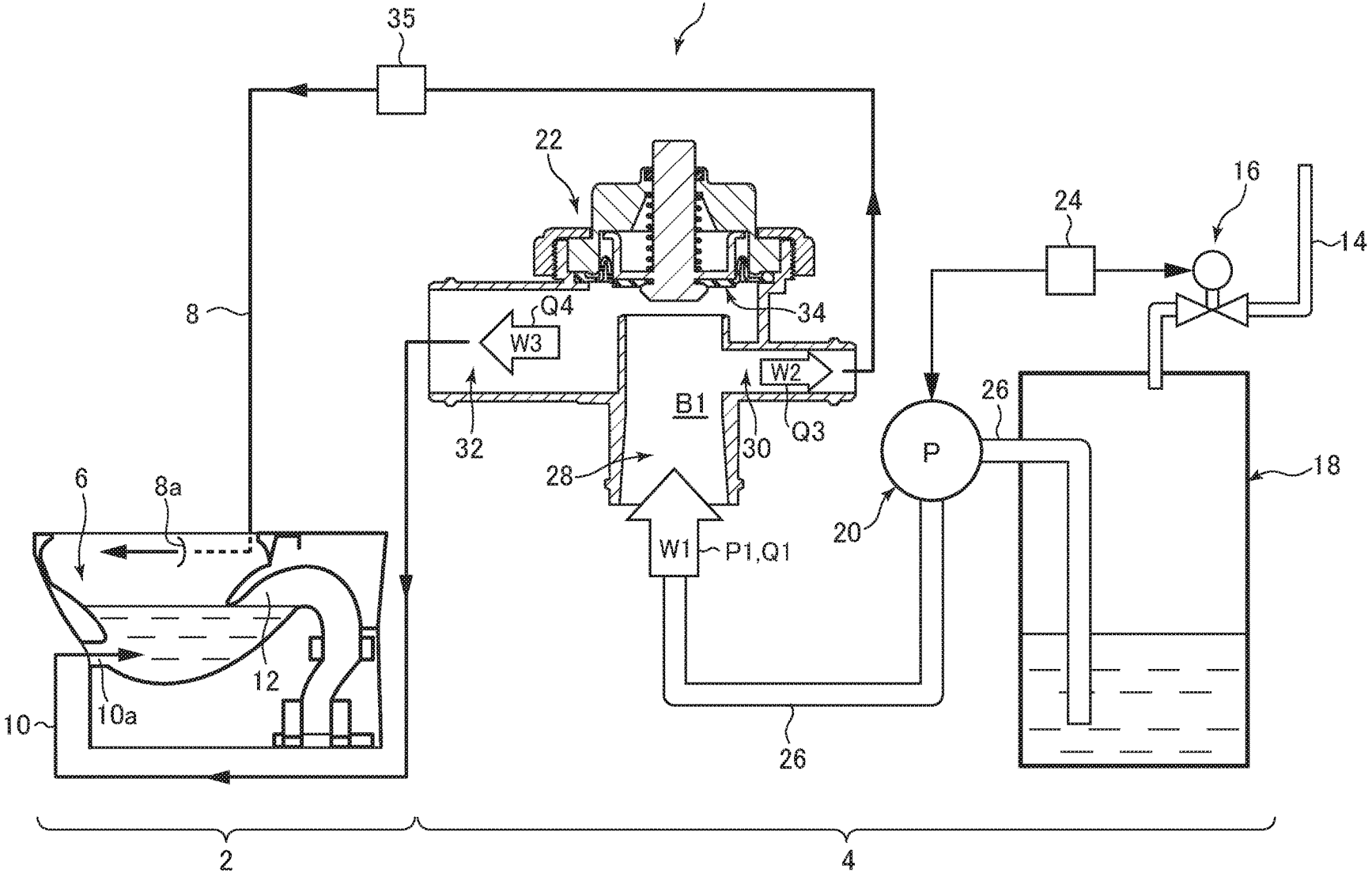
FIG. 5 is an entire schematic block diagram of the flush toilet according to one embodiment of the present invention and shows the valve open state of the switching valve device.

FIG. 4 is a time chart that shows the basic operation of the flush toilet according to one embodiment of the present invention. In addition. FIG. 5 is an entire schematic block diagram of the flush toilet according to one embodiment of the present invention and shows the valve open state of the switching valve device.

Figure 6:
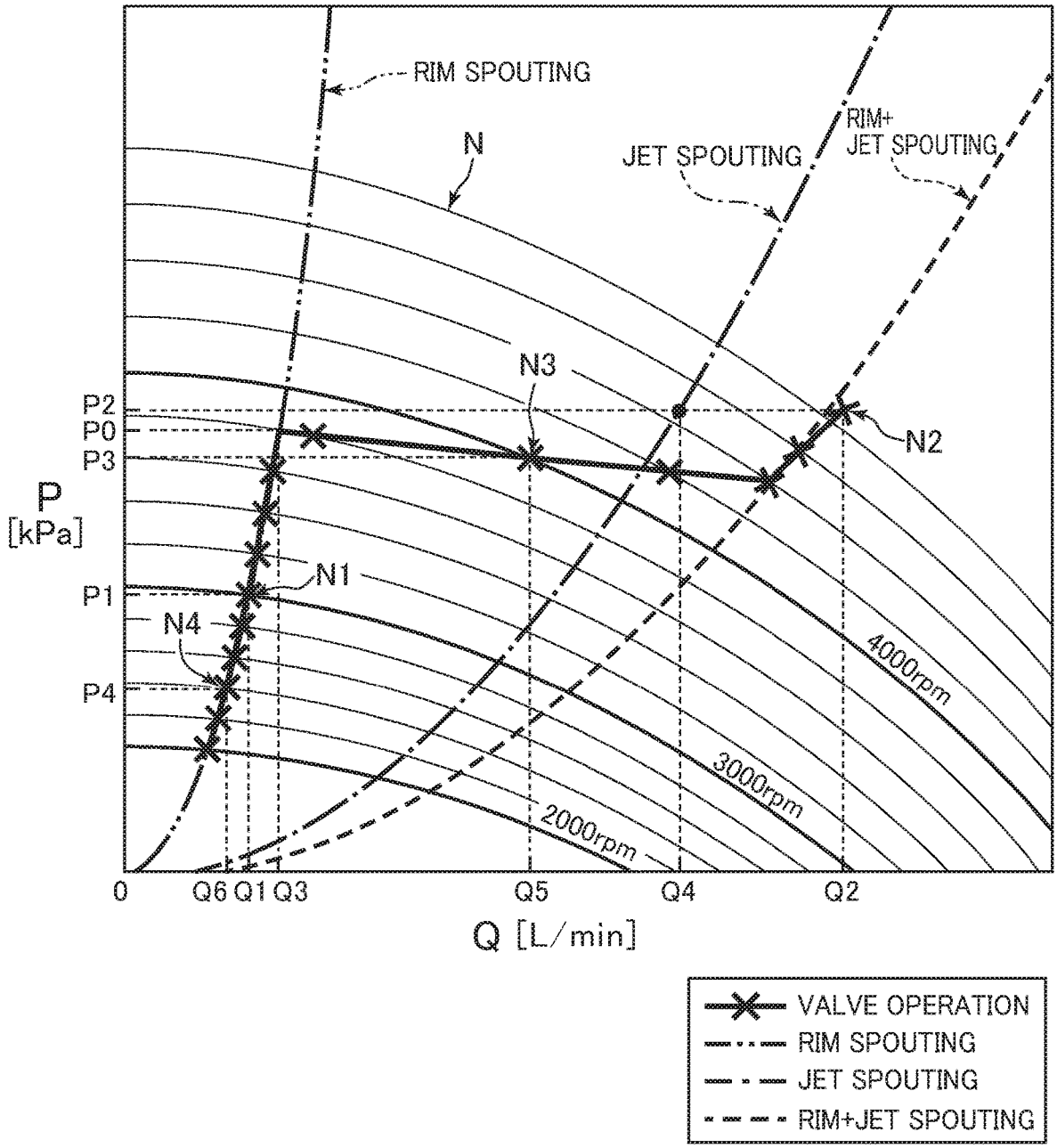
FIG. 6 is a characteristic diagram that shows the relationship between the flow rate Q [L/min] and pressure [kPa] of each of the rim spouting, jet spouting, and rim/jet spouting with respect to the rotation speed of a pressure pump in the flush toilet according to one embodiment of the present invention.

Further, FIG. 6 is a characteristic diagram that shows the relationship between the flow rate Q [L/min] and pressure [kPa] of each of the rim spouting, jet spouting, and rim/jet spouting with respect to the rotation speed of the pressure pump in the flush toilet according to one embodiment of the present invention.

In the characteristic diagram shown in FIG. 6, a plurality of curves indicating the relationship between the flow rate Q [L/min] and pressure [kPa], each of which is drawn per rotation speed N of the pressure pump 20, are drawn in a contour line form. Further, in FIG. 6, a curve indicating the relationship between the flow rate Q [L/min] and pressure

[kPa] in each of the rim spouting, jet spouting, and rim/jet spouting is drawn in a parabola form. And further, in FIG. 6, the locus of the relationship between the flow rate Q [L/min] and pressure [kPa] that can be taken when the switching valve body 34 operates is indicated by a thick line and X marks.

First, as shown in FIG. 4, when a toilet flush switch (not illustrated) is operated at time t1 after a wait state at time t0, the power of each of the solenoid valve 16 and pressure pump 20 is turned from off to on under the control of the controller 24. This causes the pressure pump 20 to operate and the rotation speed N [rpm] of the pressure pump 20 increases to a rotation speed N1 [rpm] (for example, N1=3000 rpm). This operation of the pressure pump 20 causes, as shown in FIG. 1, flush water in the flush water storage tank 18 to be supplied to the upstream side water supply channel 28 (first flow path) of the switching valve device 22 via the water supply channel 26.

At this time, as shown in FIG. 1 and FIG. 2, in the switching valve body 34 of the switching valve device 22, the biasing force F1 which is made to act on the switching valve body 34 by the compression coiled spring 36 exceeds a fluid force which is made to act on the pressure receiving surface S0 of the valve body 34*a* by the water pressure P1 (static pressure lower than the boundary water pressure P0, P1<P0) in the upstream side water supply channel 28 (first flow path) of the switching valve device 22. This keeps the valve body 34*a* at its lowest position without rising, in which the upstream end 32*c* of the transition flow path 32*a* of the jet water supply channel 32 (downstream end of an upstream side water supply channel 28) is closed (valve closed state).

Thus, as shown in FIG. 1 and FIG. 6, flush water W1 (water pressure P1 [kPa] and flow rate Q1 [L/min] in FIG. 6) which is supplied from the pressure pump 20 into the upstream side water supply channel 28 of the switching valve device 22 at the rotation speed N1 is supplied from the branch part B1 of the upstream side water supply channel 28 only to the rim water supply channel 30 (second flow path); and therefore, the flush water is not supplied to the jet water supply channel 32 (third flow path).

Then, the flush water in this rim water supply channel 30 passes through the fixed flow valve 35 and is spouted from the rim spout port 8*a* of the rim water supply passage 8 of the toilet main body 2 to the bowl 6. Thus, for the time from time t1 to time t2 shown in FIG. 4 (for example, t2−t1=2.5 seconds), a first rim spouting from the rim spout port 8*a* is executed, thereby executing a first rim flushing (so-called "pre rim flushing") as a first flushing process.

Next, as shown in FIG. 4, at time t2, the rotation speed N [rpm] of the pressure pump 20 increases from the rotation speed N1 [rpm] to a rotation speed N2 [rpm] (for example, N2=5000 rpm) (N2>N1). Then, for the time from time t2 to time t3 in FIG. 4 (for example t3−t2=1.0 seconds), the rotation speed N [rpm] of the pressure pump 20 is maintained substantially stably at the rotation speed N2 [rpm].

At this time, as shown in FIG. 2, FIG. 3, and FIG. 5, in the switching valve body 34 of the switching valve device 22, the fluid force which is made to act on the pressure receiving surface S0 of the valve body 34*a* by the water pressure (static pressure) P1 in the upstream side water supply channel 28 (first flow path) of the switching valve device 22 exceeds the biasing force F1 which is made to act on the switching valve body 34 by the compression coiled spring 36. This causes, at time t2 in FIG. 4, the valve body 34*a* to rise from the state of closing the upstream end 32*c* of the transition flow path 32*a* of the jet water supply channel 32 (the downstream end of the upstream side water supply channel 28) and to get into a valve open state (see FIG. 3).

In addition, as shown in FIG. 3, on the pressure receiving surface S0 of the valve body 34*a* in a valve open state, the water pressure (dynamic pressure) P2 starts acting and also, the fluid force corresponding to this water pressure (dynamic pressure) P2 exceeds the biasing force F2 of the compression coiled spring 36; and therefore, the valve open state of the switching valve body 34 is maintained (see FIG. 3).

Thus, as shown in FIG. 5 and FIG. 6, flush water W2 (water pressure P2 [kPa] and flow rate Q3 [L/min] in FIG. 6) that is part of the flush water W1 (water pressure P2 [kPa] and flow rate Q2 [L/min] in FIG. 6) which is supplied from the pressure pump 20 into the upstream side water supply channel 28 of the switching valve device 22 at the rotation speed N2 is supplied, for rim spouting, from the branch part B1 of the upstream side water supply channel 28 to the rim water supply channel 30 (second flow path).

At the same time, as shown in FIG. 5 and FIG. 6, flush water W3 (water pressure P2 [kPa] and flow rate Q4 [L/min] in FIG. 6) that is the remaining part of the flush water W1 (water pressure P2 [kPa] and flow rate Q2 [L/min] in FIG. 6) which is supplied from the pressure pump 20 into the upstream side water supply channel 28 of the switching valve device 22 at the rotation speed N2 is supplied, for jet spouting, from the branch part B1 of the upstream side water supply channel 28 to the jet water supply channel 32 (third flow path).

In addition, as show n in FIG. 5, the flush water W2 in the rim water supply channel 30 (flow rate Q3 [L/min]) passes through the fixed flow valve 35 and is spouted from the rim spout port 8*a* of the rim water supply passage 8 of the toilet main body 2 to the bowl 6. Thus, a second rim spouting is executed and thereby, a second rim flushing (so-called "mid rim flushing") is executed as a second flushing process.

At the same time, as shown in FIG. 5, the flush water W3 in the jet water supply channel 32 flows at a flow rate Q4 [L/min] which is higher than the flush water W2 (flow rate Q3 [L/min]) in the rim water supply channel 30; and is spouted from the jet spout port 10*a* of the jet water supply passage 10 of the toilet main body 2 to the bowl 6. Thus, a first jet spouting is executed and thereby, a first jet flushing is executed as the second flushing process.

Next, as shown in FIG. 4, at time t3, the rotation speed N [rpm] of the pressure pump 20 decreases from the rotation speed N2 [rpm] to a rotation speed N3 [rpm] that is lower than this rotation speed N2 and higher than the rotation speed N1 in the first flushing process (for example, N3=4000 rpm) (N1<N3<N2). Then, for the time from time t3 to time t4 in FIG. 4 (for example t4−t3=1.2 seconds), the rotation speed N [rpm] of the pressure pump 20 is maintained substantially stably at the rotation speed N3 [rpm].

In addition, for the time from time t3 to time t4 in FIG. 4, the rotation speed N3 [rpm] of the pressure pump 20 decreases to lower than the rotation speed N2 [rpm] of the pressure pump 20 for the time from time t2 to time t3 in FIG. 4; and accordingly, each of water pressure (dynamic pressure) P3 [kPa] and flow rate Q5 [L/min] (see FIG. 6) in the upstream side water supply channel 28 (first flow path) of the switching valve device 22 also decreases to lower than the water pressure (dynamic pressure) P2 and flow rate Q2 [L/min] (see FIG. 6) for the time from time t2 to time t3 (P3<P2, Q5<Q2).

However, also for the time from time t3 to time t4 in FIG. 4, the fluid force which is made to act on the pressure receiving surface S0 of the valve body 34*a* by the water pressure (dynamic pressure) P3 in the upstream side water supply channel 28 (first flow path) of the switching valve device 22 exceeds the biasing force F2 which is made to act on the switching valve body 34 by the compression coiled spring 36; and therefore, the valve open state of the switching valve body 34 is maintained.

Thus, a second jet spouting is executed while the execution of the second rim spouting is continued; and thereby, as the second flushing process, a second jet flushing is executed while the second rim flushing (so-called "mid rim flushing") is continuously executed.

Consequently, for the time from time t2 to time t4 shown in FIG. 4, rim spouting from the rim spout port 8*a* and jet spouting from the jet spout port 10*a*, so-called "rim/jet spouting," is executed and thereby, both the mid rim flushing and jet flushing are parallelly executed as the second flushing process.

Next, as shown in FIG. 4, at time t4, the rotation speed N [rpm] of the pressure pump 20 decreases from the rotation speed N3 [rpm] to a rotation speed N4 [rpm] that is lower than the rotation speed N1 in the first flushing process (for example, N4=2500 rpm) (N4<N1<N3). Then, for the time from time t4 to time t5 in FIG. 4 (for example, t5−t4=5.0 seconds), the rotation speed N [rpm] of the pressure pump 20 is maintained substantially stably at the rotation speed N4 [rpm].

In addition, for the time from time t4 to time t5 in FIG. 4, the rotation speed N4 [rpm] of the pressure pump 20 decreases to lower than the rotation speed N1 [rpm] of the pressure pump 20 for the time from time t1 to time t2 in FIG. 4; and accordingly, each of the water pressure (static pressure) P4 [kPa] and flow rate Q6 [L/min] (see FIG. 6) in the upstream side water supply channel 28 (first flow path) of the switching valve device 22 for the time from time t4 to time t5 also decreases to lower than the water pressure (static pressure) P1 and flow rate Q1 [L/min] (see FIG. 6) for the time from time t2 to time t3 (P4<P1, Q6<Q1).

At this time, as shown in FIG. 1 and FIG. 2, in the switching valve body 34 of the switching valve device 22, the biasing force F1 which is made to act on the switching valve body 34 by the compression coiled spring 36 exceeds a fluid force which is made to act on the pressure receiving surface S0 of the valve body 34*a* by the water pressure P4 (static pressure) in the upstream side water supply channel 28 (first flow path) of the switching valve device 22. This causes the valve body 34*a* of the switching valve body 34 after time t4 to come down to its lowest position, in which the upstream end 32*c* of the transition flow path 32*a* of the jet water supply channel 32 (downstream end of an upstream side water supply channel 28) is closed (valve closed state) again.

Thus, as shown in FIG. 1 and FIG. 6, the flush water which is supplied from the pressure pump 20 into the upstream side water supply channel 28 of the switching valve device 22 at the rotation speed N4 (water pressure P4 [kPa] and flow rate Q6 [L/min] in FIG. 6) is supplied from the branch part B1 of the upstream side water supply channel 28 only to the rim water supply channel 30 (second flow path); and therefore, the flush water is not supplied to the jet water supply channel 32 (third flow path).

Then, with the flush water in this rim water supply channel 30, a third rim spouting from the rim spout port 8*a* is executed for the time from time t4 to time t5 shown in FIG. 4 (for example, t5−t4=5.0 seconds), and thereby a third rim flushing (so-called "post rim flushing") is executed as a third flushing process.

Incidentally, as shown in FIG. 1, FIG. 4, and FIG. 5, water supply from the water supply pipe 14 to the flush water storage tank 18 is performed by the open/close control of the solenoid valve 16 by the controller 24, and the solenoid valve 16 is opened for the time from time t1 to time t6 in FIG. 4, in which water supply to the flush water storage tank 18 is executed.

It should be noted that the times t0 to t6, the rotation speeds N1 to N4 of the pressure pump 20, and the like which are shown in FIG. 4 can be modified as appropriate according to the specifications of the flush toilet 1 and are not limited.

According to the flush toilet 1 of one embodiment of the present invention described above, the switching valve body 34 of the switching valve device 22 can mechanically operate by receiving the water pressure of the flush water which has been pressurized by the pressure pump 20. This allows efficient switching of the water supply path to be performed according to the water pressure generated by the operation of the pressure pump 20; specifically, for example, efficient switching to the water supply path (rim water supply passage 8 and rim water supply channel 30) for executing only rim spouting in the first flushing process ("pre rim flushing" process shown in FIG. 4) for spouting from the rim spout port 8*a* of the toilet main body 2, and efficient switching to the water supply path (rim water supply passage 8 and rim water supply channel 30, and jet water supply passage 10 and jet water supply channel 32) for executing rim/jet spouting in the second flushing process ("mid rim flushing/jet flushing" process shown in FIG. 4) for spouting from the jet spout port 10*a* of the toilet main body 2 while continuing rim spouting.

For example, as shown in FIG. 4, when switching from the first flushing process (pre rim flushing process) to the second flushing process (mid rim flushing/jet flushing process) is performed by the switching valve device 22, the rotation speed N [rpm] of the pressure pump 20 is adjusted to increase to N2 as shown in FIG. 3. FIG. 4, and FIG. 6 and thereby, water pressure P in the water supply channel 26 is adjusted to the water pressure P2 that is higher than the boundary water pressure P0.

This allows the switching valve body 34 that has received a relatively high water pressure P2 to mechanically operate with good responsiveness so as to open the upstream end of the jet water supply channel 32 for executing rim/jet spouting.

Thus, in jet spouting from the jet spout port 10*a* of the toilet main body 2, the occurrence of wasteful water flow, which does not contribute to the occurrence of siphonage in the bowl 6 and discharge trap conduit 12 of the toilet main body 2, can be suppressed.

In addition, as shown in FIG. 4, at the end of the second flushing process (mid rim flushing/jet flushing process), the water pressure P4 in the water supply channel 26 is adjusted to a water pressure lower than the boundary water pressure P0 by the pressure pump 20.

This allows the switching valve body 34 that has received a relatively low water pressure P4 to mechanically operate with good responsiveness so as to close the jet water supply channel 32.

Thus, also after the second flushing process (mid rim flushing/jet flushing process), the occurrence of a wasteful water flow can be suppressed.

In addition, the switching valve body 34 of the switching valve device 22 mechanically operates by receiving the water pressure of the flush water pressurized by the pressure pump 20; and this eliminates the need for a motor, solenoid valve, or the like, which is electrically operated, for generating a relatively high torque in the switching valve device 22.

Consequently, a device including the switching valve device 22, itself, can be miniaturized and also, the flexibility in installing the switching valve device 22 can be improved. Thus, the miniaturization of the whole flush toilet 1 can also be achieved.

In addition, according to the flush toilet 1 of the present embodiment, through switching of the water supply path by the switching valve device 22, the first flushing process (pre rim flushing process) is executed to execute rim spouting for spouting the flush water in the water supply channels 26 and 28 from the rim spout port 8*a* and after that, the second flushing process (mid rim flushing/jet flushing process) is executed to execute jet spouting for spouting the flush water in the water supply channels 26 and 28 also from the jet spout port 10*a* while continuing rim spouting, thereby allowing rim/jet spouting to be surely executed.

Further, in the second flushing process (mid rim flushing/jet flushing process), even when siphonage occurs in the bowl 6 or discharge trap conduit 12 of the toilet main body 2 due to jet spouting, rim spouting is continued, thereby allowing odors to be suppressed from rising in the toilet main body 2.

In addition, according to the flush toilet 1 of the present embodiment, in the switching valve device 22, the rim water supply channel 30 for supplying flush water from the water supply channels 26 and 28 to the rim spout port 8*a* is provided in the water supply channel 28 on the upstream side of the switching valve body 34 of the switching valve device 22 and the jet water supply channel 32 for supplying flush water from the water supply channel 28 to the jet spout port 10*a* at a relatively high flow rate is provided on a downstream side of the switching valve body 34 of the switching valve device 22. This allows flush water to be surely supplied to the rim water supply channel 30 at the branch part B1 of the water supply channel 28 on an upstream side of the switching valve device 22.

Accordingly, in the second flushing process (mid rim flushing/jet flushing process), etc., such a situation that the flush water to be supplied to the rim water supply channel 30 is drawn to the jet water supply channel 32 on the downstream side of the switching valve body 34 of the switching valve device 22, causing the shortage of a supply amount to the rim water supply channel 30 can be prevented.

Thus, the device including the switching valve device 22 can be miniaturized while maintaining the flushing performance of the flush toilet 1 and also, the whole flush toilet 1 can be miniaturized.

In addition, according to the flush toilet 1 of the present embodiment, the switching valve body 34 of the switching valve device 22 can open and close only the jet water supply channel 32.

Therefore, in each of the flushing processes of the first flushing process (pre rim flushing process) and the second flushing process (mid rim flushing/jet flushing process), the rim water supply channel 30 is always open without being closed by the switching valve body 34 of the switching valve device 22, allowing at least rim spouting to be executed.

Further, a water supply path provided with the switching valve body 34 of the switching valve device 22 is limited to only the jet water supply channel 32 and this can miniaturize the device including the switching valve device 22 and can also miniaturize the whole flush toilet.

In addition, according to the flush toilet 1 of the present embodiment, the upstream end 32*c* of the jet water supply channel 32, which is opened and closed by the switching valve body 34 of the switching valve device 22, is located above the upstream end of the rim water supply channel 30.

Therefore, in a state where the switching valve body 34 closes the upstream end 32*c* of the jet water supply channel 32, the flush water in the upstream side water supply channel 28 of the switching valve device 22 can be discharged from the rim water supply channel 30 below the switching valve body 34 and on the upstream side of it, without being accumulated in the vicinity of the upstream end of the jet water supply channel 32, thereby allowing efficient draining.

This can suppress the adhesion of scale and the like to the switching valve body 34 for a long time due to submersion of the switching valve body 34 of the switching valve device 22 all the time and accordingly, can prevent the malfunction and deterioration of the switching valve body 34.

In addition, according to the flush toilet 1 of the present embodiment, the switching valve body 34 of the switching valve device 22 is located above the overflow water level WO in the flush water storage tank as shown in FIG. 1 and therefore, the switching valve body 34 can be surely prevented from being submerged due to the flush water in the flush water storage tank 18; and thus the malfunction and deterioration of the switching valve body 34 can be prevented.

In addition, according to the flush toilet 1 of the present embodiment, especially in the second flushing process (mid rim flushing/jet flushing process), the flush water in the water supply channel 26 is pressure-fed at a relatively high flow rate Q2 [L/min] by pressurization of the pressure pump 20 and therefore, even into the rim water supply channel 30 which is not provided with the switching valve body 34 of the switching valve device 22, flush water at a relatively high flow rate Q3 [L/min] flows.

Therefore, the fixed flow valve 35 is provided in either one of the rim water supply channel 30 of the switching valve device 22 or the rim water supply passage 8 of the toilet main body 2, so that the flow rate Q [L/min] of the flush water which is spouted from the rim spout port 8*a* via the rim water supply channels 30 and rim water supply passage 8 (rim spouting) can be adjusted to a fixed flow rate by the fixed flow valve 35.

Thus, the outside water leakage such as splashing of the flush water, which is spouted into the bowl 6 of the toilet main body 2, to the outside can be suppressed.

In addition, according to the flush toilet 1 of the present embodiment, the switching valve device 22 includes the compression coiled spring 36 that biases the switching valve body 34 in a valve closed direction. Therefore, as shown in FIG. 3 and FIG. 5, the lower surface (pressure receiving surface S0) of the valve body 34*a* of the switching valve body 34 can operate in a valve open direction against the biasing force of the compression coiled spring 36 when in a state of receiving the water pressure that is equal to or higher than the predetermined water pressure (boundary water pressure P0 [kPa] in FIG. 6).

Thus, the switching valve device 22 can be miniaturized with a simple structure and accordingly, the whole flush toilet can also be miniaturized.

In addition, according to the flush toilet 1 of the present embodiment, as shown in FIG. 4 and FIG. 6, the switching valve device 22 can switch the water supply path only to the rim water supply channel 30 so as to execute the third flushing process (post rim flushing process) for spouting flush water from the rim spout port 8*a* while continuing spouting flush water from the rim spout port 8*a* after the second flushing process (mid rim flushing/jet flushing process).

In addition, the pressure pump 20 allows such an adjustment that the flow rate Q6 [L/min] of flush water which is pressure-fed in the third flushing process (post rim flushing process) is lower than the flow rate Q2 [L/min] of flush water which is pressure-fed in the second flushing process (mid rim flushing/jet flushing process).

Thus, when the third flushing process (post rim flushing process) is executed after the second flushing process (mid rim flushing/jet flushing process), the water pressure P in the water supply channel 28 is adjusted to a low pressure state (see the water pressure P4 in FIG. 6) and accordingly, the water supply path (jet water supply channel 32) in the second flushing process (mid rim flushing/jet flushing process) is closed, thereby allowing quick switching to the water supply path (only the rim water supply channel 30) in the third flushing process (post rim flushing process).

Thus, the third flushing process (post rim flushing process) can be executed with good responsiveness.

Next, according to the flush toilet 1 of one embodiment of the present invention described above, the surface (pressure receiving surface S0) by which the valve body 34*a* of the switching valve body 34 of the switching valve device 22 receives the water pressure of the flush water which is pressurized by the pressure pump 20 can be opposed in the central axis C1 direction (flow path axial direction) of the upstream side water supply channel 28.

Therefore, the pressure receiving surface S0 of the valve body 34*a* of the switching valve body 34 can effectively receive the water pressure and can mechanically operate in the axial direction (operating axial direction) of the valve shaft 34*c* of the switching valve body 34 which is the same direction as the central axis C1 direction (flow path axial direction) of the upstream side water supply channel 28.

In addition, for example, when the switching valve body 34, which is in a closed state (see FIG. 2), is opened, the compression coiled spring 36 is biasing all the time at a biasing force F1 in the operating axial direction for closing the switching valve body 34. This allows the switching valve body 34 to start to be opened when the pressure receiving surface S0 of the valve body 34*a* receives the water pressure exceeding the biasing force F1 of the compression coiled spring 36 (the water pressure equal to or higher than the boundary water pressure P0). Thus, an abrupt change from the valve open state to the valve closed state of the switching valve body 34 can be suppressed.

Especially, when the switching valve body 34 is rising in the operating axial direction (valve open direction) from the closed state (see FIG. 2) to the valve open state (see FIG. 3), the buffer force if of the annular seal member 38 in a direction perpendicular to the operating axial direction of the switching valve body 34 allows a valve opening speed to be suppressed for buffering, and thereby the valve opening operation in the operating axial direction of the switching valve body 34 can be appropriately moderated.

On the other hand, immediately before the switching valve body 34 falls in the operating axial direction (valve closed direction) from the valve open state (see FIG. 3) to the closed state (see FIG. 2), the buffer force f0 of the annular seal member 38 in the direction perpendicular to the operating axial direction of the switching valve body 34 allows a valve closing speed to be suppressed for buffering and therefore, the valve closing operation in the operating axial direction of the switching valve body 34 can be appropriately moderated.

In addition, also when the pressure receiving surface S0 of the valve body 34*a* of the switching valve body 34 receives a water pressure, the buffer part (annular seal member 38) can suppress the vibration of the switching valve body 34 itself due to the water pressure; and therefore, the operation of the switching valve body 34 can be stabilized.

Thus, an abrupt change of the open/closed state of the switching valve body 34 can be prevented and also the behavior in the operation of the switching valve body 34 can be stabilized by suppressing an overshoot and an undershoot. Thus, a spout flow rate can be stabilized and also water saving can be achieved by suppressing wasteful water in spouting.

In addition, according to the flush toilet 1 of the present embodiment, the valve shaft 34*c* which is provided so as to extend in the operating axial direction from the switching valve body 34 can be slidably supported in the operating axial direction via the annular seal member 38 by the support member 40 of the switching valve device 22.

Therefore, an appropriate sliding resistance due to a dynamic friction force, etc. can be applied to the valve shaft 34*c* of the switching valve body 34, which slides in the operating axial direction, by the annular seal member 38.

Thus, the opening/closing operation of the switching valve body 34 can be stabilized and accordingly the switching between the water supply paths 30 and 32 by the switching valve device 22 can be stabilized.

In addition, according to the flush toilet 1 of the present embodiment, the annular seal member 38, which is held by the support member 40 in a state where the valve shaft 34*c* of the switching valve body 34 is inserted, can apply the buffer force f0 almost uniformly to an entire perimeter of the valve shaft 34*c* and accordingly, can apply an almost uniform, appropriate sliding resistance to the perimeter of the valve shaft 34*c* that slides in the operating axial direction.

Thus, the opening/closing operation of the switching valve body 34 can be more stabilized and accordingly the switching between the water supply paths 30 and 32 by the switching valve device 22 can be more stabilized.

In addition, according to the flush toilet 1 of the present embodiment, first, in executing the first flushing process (pre rim flushing process), the switching valve body 34 of the switching valve device 22 is brought into a valve closed state (see FIG. 2) and the flush water in the water supply channel 28 is spouted at a relatively low flow rate from the rim spout port 8*a* via the rim water supply channel 30 and rim water supply passage 8.

After that, in executing the second flushing process (mid rim flushing/jet flushing process), the switching valve body 34 of the switching valve device 22 is switched from a valve closed state (see FIG. 2) to a valve open state (see FIG. 3) and while spouting of flush water from the rim spout port 8*a* (rim spouting) is continued, spouting of flush water from the jet spout port 10*a* via the jet water supply channel 32 and jet water supply passage 10 (jet spouting) is also performed at a relatively high flow rate.

That is, in switching from a water supply path for the first flushing process (pre rim flushing process) to a water supply path for the second flushing process (mid rim flushing/jet flushing process) as described above, the switching valve body 34 of the switching valve device 22 operates so as to be brought into a valve open state in which a relatively high water pressure is received, from a valve closed state in which a relatively low water pressure is received.

However, the rim water supply channel 30 whose flow rate is relatively low is provided in the water supply channel 28 on the upstream side of the switching valve body 34 of the switching valve device 22, and the jet water supply channel 32 whose flow rate is relatively high is provided on the downstream side of the switching valve body 34 of the switching valve device 22. This allows the suppression of an abrupt change from the valve closed state to the valve open state of the switching valve body 34, thereby allowing the suppression of the overshoot of the switching valve body 34.

Especially, the occurrence of an abrupt pressure change from the water supply channel 28 to the rim water supply channel 30 can also be suppressed and therefore, stable spouting can be performed without affecting the rim spouting which is continuously performed from the first flushing process (pre rim flushing process) to the second flushing process (mid rim flushing/jet flushing process).

In addition, according to the flush toilet 1 of the present embodiment, in switching from a water supply path for the second flushing process (mid rim flushing/jet flushing process) to a water supply path for the third flushing process (post rim flushing process), the switching valve body 34 of the switching valve device 22 is supposed to operate so as to be abruptly brought into a valve closed state in which a relatively low water pressure is received, from a valve open state in which a relatively high water pressure is received.

In this case, an abrupt change of the switching valve body 34 from the valve open state to the valve closed state can be suppressed and therefore, the undershoot of the switching valve body 34 can be suppressed.

Thus, especially, the occurrence of an abrupt pressure change from the water supply channel 28 to the rim water supply channel 30 can also be suppressed and therefore, stable spouting can be performed without affecting the rim spouting which is continuously performed from the second flushing process (mid rim flushing/jet flushing process) to the third flushing process (post rim flushing process).

Figure 7:
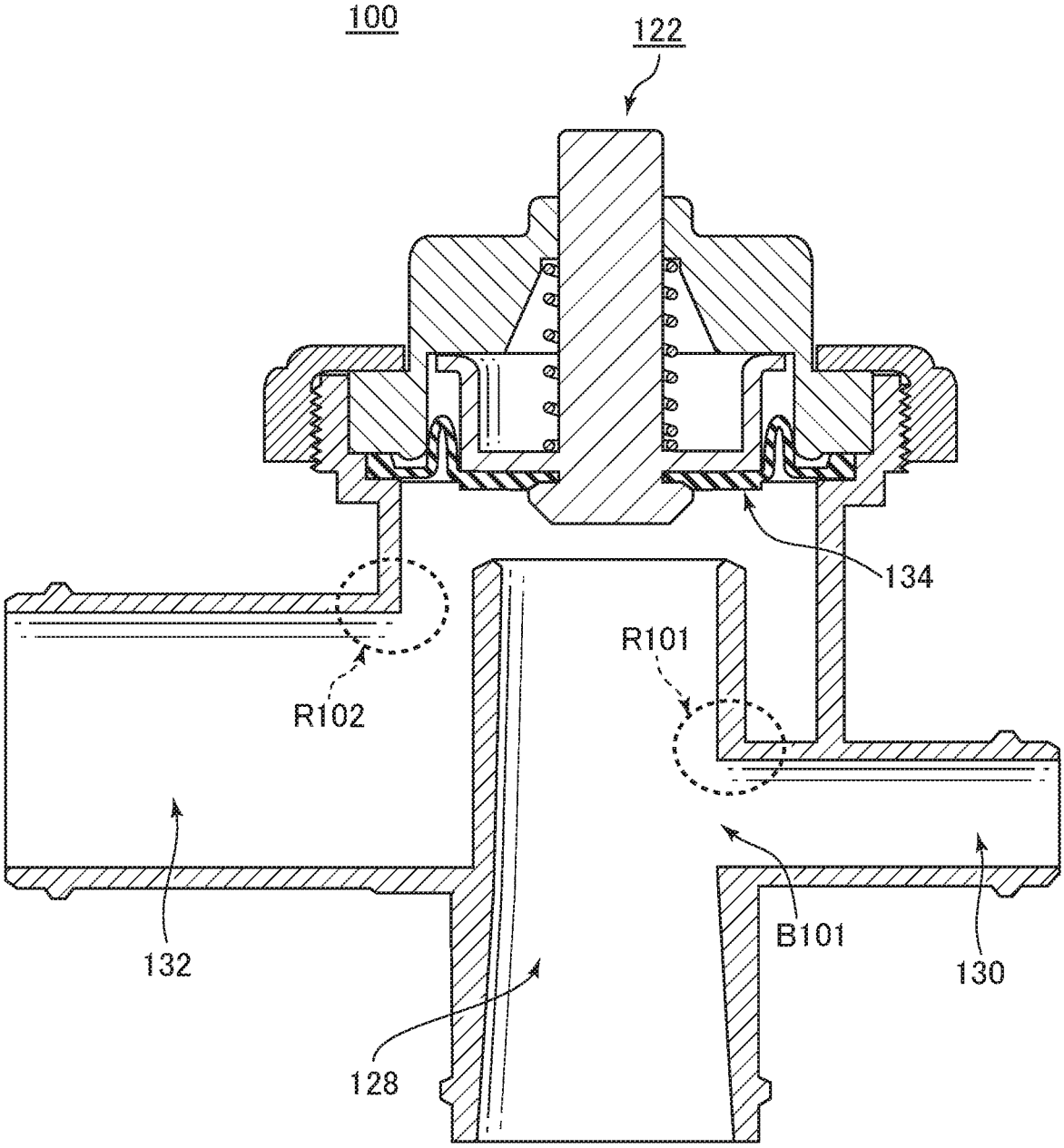
FIG. 7 shows a comparison example of the switching valve device of the flush toilet according to one embodiment of the present invention shown in FIG. 3.

Next, FIG. 7 shows a comparison example of the switching valve device of the flush toilet according to one embodiment of the present invention shown in FIG. 3.

As shown in FIG. 7, in a flush toilet 100 as a comparison example that is different from the flush toilet 1 of one embodiment of the present invention, flow paths at a branch part 8101, which branches to a rim water supply channel 130 in an upstream side water supply channel 128, and on its downstream side (rim water supply channel 130 and jet water supply channel 132) are complicated in a state where a switching valve body 134 of a switching valve device 122 has been switched from a valve closed state to a valve open state. This causes a vortex flow, etc. at those complicated flow path parts (for example, see areas R101 and R102 in FIG. 7 where a vortex flow easily occurs). Consequently, the flow rate of flush water to be supplied to the rim spout port 8*a* and jet spout port 10*a* becomes unstable and in addition, an abnormal sound occurs.

On the other hand, in the above described flush toilet of the present invention, as shown in FIG. 1 to FIG. 6, rim spouting is executed in the first flushing process (pre rim flushing process) for spouting the flush water in the water supply channel 28 of the switching valve device 22 from the rim spout port 8*a* via the rim water supply channel 30 and rim water supply passage 8 and after that, rim jet spouting is executed in the second flushing process (mid rim flushing/jet flushing process) for spouting flush water in the water supply channel 28 from the jet spout port 10*a* via the jet water supply channel 32 and jet water supply passage 10 while continuing spouting from the rim spout port 8*a*.

In this situation, the switching valve body 34 of the switching valve device 22 has been switched from the valve closed state to the valve open state as shown in FIG. 3.

In this valve open state of the switching valve body 34, the first flow path cross-sectional area A1 on the upstream side of the branch part B1 in the upstream side water supply channel 28 (first flow path) is different from the second flow path cross-sectional area A2 in the upstream side water supply channel 28 (first flow path) on the downstream side of the branch part B1. This makes the flush water which has flowed from the upstream side into the branch part B1 easily flow into the upstream side water supply channel 28 (first flow path) and rim water supply channel 30 (second flow path) on the downstream side of the branch part B1.

Thus, a vortex flow can be suppressed from occurring either in the vicinity of the branch part B1 for branching from the upstream side water supply channel 28 (first flow path) to the rim water supply channel 30 (second flow path) or in the upstream side water supply channel 28 (first flow path) and rim water supply channel 30 (second flow path) on the downstream side of the branch part.

Therefore, even in a state where the water supply path for rim spouting (rim water supply channel 30 and rim water supply passage 8) in the first flushing process (pre rim flushing process) has been switched to the water supply path for rim/jet spouting (rim water supply channel 30 and rim water supply passage 8, and jet water supply channel 32 and jet water supply passage 10) in the second flushing process (mid rim flushing/jet flushing process), the occurrence of an abnormal sound can be suppressed while flushing performance by rim/jet spouting is maintained.

In addition, according to the flush toilet 1 of the present embodiment, the second flow path cross-sectional area A2 of the upstream side water supply channel 28 (first flow path) of the switching valve device 22 is greater than the first flow path cross-sectional area A1 of the upstream side water supply channel 28 (first flow path). Therefore, in a state where the switching valve body 34 is open as shown in FIG. 3, a vortex flow can be effectively suppressed from occurring either in the vicinity of the branch part B1 for branching from the upstream side water supply channel 28 (first flow path) to the rim water supply channel 30 (second flow path) or in the upstream side water supply channel 28 (first flow path) and rim water supply channel 30 (second flow path) on the downstream side of the branch part.

In addition, according to the flush toilet 1 of the present embodiment, the third flow path cross-sectional area A3 of the main flow path 32*b* of the jet water supply channel 32 (third flow path) of the switching valve device 22 is greater than the second flow path cross-sectional area A2 of the upstream side water supply channel 28 (first flow path). Therefore, in a state where the switching valve body 34 is open as shown in FIG. 3, the flush water which has passed through a flow path cross section of the second flow path cross-sectional area A2 of the upstream side water supply channel 28 (first flow path) can actively and smoothly flow into the jet water supply channel 32 (third flow path) on a downstream side of the cross section.

Consequently, when the switching valve body 34 is open, the occurrence of a vortex flow in a flow from the upstream side water supply channel 28 (first flow path) into the jet water supply channel 32 (third flow path) can be effectively suppressed.

In addition, according to the flush toilet 1 of the present embodiment, the second flow path cross-sectional area A2 of the upstream side water supply channel 28 (first flow path) of the switching valve device 22 is greater than the fourth flow path cross-sectional area A4 of the rim water supply channel 30 (second flow path). Therefore, in a state where the switching valve body 34 is open as shown in FIG. 3, the flow rate of the flush water passing through the flow path cross section of the second flow path cross-sectional area A2 of the upstream side water supply channel 28 (first flow path) becomes higher than the flow rate of the flush water passing through the flow path cross section of the fourth flow pass cross-sectional area A4 of the rim water supply channel 30 (second flow path).

Consequently, a vortex flow can be effectively suppressed from occurring either in the vicinity of the branch part B1 for branching from the upstream side water supply channel 28 (first flow path) to the rim water supply channel 30 (second flow path) or in the upstream side water supply channel 28 (first flow path) and rim water supply channel 30 (second flow path) on the downstream side of the branch part.

In addition, according to the flush toilet 1 of the present embodiment, the first flow path cross-sectional area A1 of the upstream side water supply channel 28 (first flow path) of the switching valve device 22 is greater than the fourth flow path cross-sectional area A4 of the rim water supply channel 30 (second flow path). Therefore, in a state where the switching valve body 34 is open as shown in FIG. 3, the flush water which has passed through the flow path cross section of the first flow path cross-sectional area A1 of the upstream side water supply channel 28 (first flow path) can actively flow at a high flow rate, via the branch part B1, toward the switching valve body 34 on the further downstream side of the upstream side water supply channel 28 (first flow path) than the rim water supply channel 30 (second flow path).

Consequently, a vortex flow can be effectively suppressed from occurring either in the vicinity of the branch part B1 for branching from the upstream side water supply channel 28 (first flow path) to the rim water supply channel 30 (second flow path) or in the upstream side water supply channel 28 (first flow path) and rim water supply channel 30 (second flow path) on the downstream side of the branch part.

In addition, according to the flush toilet 1 of the present embodiment, as shown in FIG. 3, the upstream end 32*c* of the transition flow path 32*a* of the jet water supply channel 32 (third flow path) which is opened and closed by the switching valve body 34 is located below the upper end 32*d* of the main flow path 32*b* of the jet water supply channel 32 (third flow path) that extends laterally with respect to the rim water supply channel 30 (second flow path). Therefore, in a state where the switching valve body 34 is open, when flush water flows from the downstream end 32*c* of the upstream side water supply channel 28 (first flow path) into the transition flow path 32*a* of the jet water supply channel 32 (third flow path), a wide flow region can be secured between the upstream end 32*c* of the transition flow path 32*a* and the upper end 32*d* of the main flow path 32*b*.

Further, in flowing from the transition flow path 32*a* into the main flow path 32*b*, flush water can be suppressed from colliding against the upper end 32*d* of the main flow path 32*b*.

Thus, when the switching valve body 34 is open, the occurrence of a vortex flow in a flow from the upstream side water supply channel 28 (first flow path) into the jet water supply channel 32 (third flow path) can be effectively suppressed.

In addition, according to the flush toilet 1 of the present embodiment, as shown in FIG. 2, the central axis C2 (second flow path central axis) that extends along the rim water supply channel 30 (second flow path) from the branch part B1 of the upstream side water supply channel 28 (first flow path) intersects, at right angles or acute angles, with the central axis C1 (first flow path central axis) that extends from the branch part B1 toward the downstream side of the upstream side water supply channel 28 (first flow path).

Thus, the flush water, which has flowed from the upstream side into the branch part B1 of the upstream side water supply channel 28 (first flow path), flows into the upstream side water supply channel 28 (first flow path) on the downstream side of the branch part B1 and also can easily branch and flow from the branch part B1 into the rim water supply channel 30 (second flow path), too.

Consequently, a vortex flow can be effectively suppressed from occurring either in the vicinity of the branch part B1 for branching from the upstream side water supply channel 28 (first flow path) to the rim water supply channel 30 (second flow path) or in the upstream side water supply channel 28 (first flow path) and rim water supply channel 30 (second flow path) on the downstream side of the branch part.

Next, according to the flush toilet 1 of one embodiment of the present invention described above, as shown in FIG. 2 and FIG. 3, the switching valve body 34 of the switching valve device 22 is arranged at an opposing position on the axial direction of the upstream side water supply channel 28 (first flow path).

Therefore, in a state where the switching valve body 34 is closed by receiving the water pressure P1 of the flush water W1 which is supplied from the pressure pump 20 to the upstream side water supply channel 28 (first flow path) as shown in FIG. 2, the water pressure P1 (more precisely, static pressure) can act almost uniformly on the pressure receiving surface S0 of the valve body 34*a* of the switching valve body 34.

In addition, in a state where the switching valve body 34 is opened by receiving the water pressure of the flush water W1 which is supplied from the pressure pump 20 to the upstream side water supply channel 28 (first flow path) as shown in FIG. 3 and FIG. 5, the water pressure P2 (more precisely, dynamic pressure) can be made to act almost uniformly on the pressure receiving surface S0 of the valve body 34*a* of the switching valve body 34.

Thus, the valve opening operation of the switching valve body 34 can be stabilized.

In addition, according to the flush toilet 1 of the present embodiment, as shown in FIG. 3, the flow path cross-sectional area perpendicular to the central axis C1 of the upstream side water supply channel 28 (first flow path) in the transition flow path 32*a* of the jet water supply channel 32 (third flow path) and the flow path cross-sectional area A3 in the main flow path 32*b* of the jet water supply channel 32 (third flow path) are set to be greater than the flow path cross-sectional area A2 of the upstream side water supply channel 28 (first flow path).

Therefore, in a state where the switching valve body 34 is open as shown in FIG. 3, when the flush water W1 in the upstream side water supply channel 28 (first flow path) passes through the switching valve body 34 and flows into the transition flow path 32*a* of the jet water supply channel 32 (third flow path), this flow of the flush water W3 in the transition flow path 32*a* can spread almost uniformly in a perpendicular direction and a circumferential direction with respect to the axial direction (axial direction of the central axis C1) of the upstream side water supply channel 28 (first flow path).

Thus, the flush water W1 in the upstream side water supply channel 28 (first flow path) can be suppressed from flowing locally to the valve body 34*a* of the switching valve body 34 after valve opening. This allows the water pressure P2 (more precisely, dynamic pressure) that acts on the pressure receiving surface S0 of the valve body 34*a* of the switching valve body 34 to act uniformly without varying due to fluctuations.

Consequently, the operation of the switching valve body 34 in switching the water supply paths 30 and 32 can be stabilized and accordingly, for example, in the first flushing process (pre rim flushing process) for spouting the flush water in the water supply channel 28 from the rim spout port 8*a* via the rim water supply channel 30 and rim water supply passage 8, rim spouting can be stably executed. After that, in executing rim/jet spouting in the second flushing process (mid rim flushing/jet flushing process) for spouting the flush water in the water supply channel 28 from the jet spout port 10*a* via the jet water supply channel 32 and jet water supply passage 10 while continuing spouting from the rim spout port 8*a*, the stabilization of rim spouting and jet spouting can be achieved.

In addition, according to the flush toilet 1 of the present embodiment, as shown in FIG. 2 and FIG. 3, the flow path cross-sectional area A2 on the downstream side of the branch part B1 in the upstream side water supply channel 28 (first flow path) (on the side of the switching valve body 34 of the upstream side water supply channel 28 (first flow path)) is set to be greater than the flow path cross-sectional area A1 of the upstream side water supply channel 28 (first flow path) on the upstream side of the branch part B1.

This allows, in a state where the switching valve body 34 is open as shown in FIG. 3, an action surface of the pressure receiving surface S0 of the valve body 34*a* of the switching valve body 34, on which the water pressure P2 (dynamic pressure) of the flush water W1 having passed through the flow path cross-sectional area A2 on the side of the switching valve body 34 in the upstream side water supply channel 28 (first flow path) acts, to be increased.

Further, in the water supply channel 28 on the upstream side of the branch part B1 in the upstream side water supply channel 28 (first flow path), its flow path cross-sectional area is smaller than that of the upstream side water supply channel 28 (first flow path) on the downstream side of the branch part B1 and accordingly, the velocity of flush water becomes higher than that in the upstream side water supply channel 28 (first flow path) on the downstream side of the branch part B1. Therefore, the flush water can easily flow toward the switching valve body 34 on the downstream side.

This makes the switching valve body 34 easily operate according to the water pressure of the flush water W1 in the upstream side water supply channel 28 (first flow path), thereby allowing a stable opening/closing operation to be performed.

Consequently, the operation of the switching valve body 34 in switching between the water supply paths 30 and 32 can be stabilized and the stabilization of rim spouting and jet spouting can be achieved.

In addition, according to the flush toilet 1 of the present embodiment, as shown in FIG. 2 and FIG. 3, the upstream side water supply channel 28 (first flow path) of the switching valve device 22 is formed in a cylindrical shape and the center O1 of the valve body 34*a* of the switching valve body 34 is located on the central axis of the upstream side water supply channel 28 (first flow path). This allows the water pressure of the flush water W1 in the upstream side water supply channel 28 (first flow path) to act on the valve body 34*a* of the switching valve body 34 in the entire circumferential direction.

Thus, the operation of the switching valve body 34 in switching the water supply paths 30 and 32 can be more stabilized.

In addition, according to the flush toilet 1 of the present embodiment, the first flushing process (pre rim flushing process) is executed by switching between the water supply paths 30 and 32 by the switching valve device 22 as shown in FIG. 1, FIG. 2, and FIG. 4, to execute rim spouting for spouting the flush water W1 in the water supply channel 28 from the rim spout port 8*a* via the rim water supply channel 30 and rim water supply passage 8.

After that, as shown in FIG. 3 to FIG. 5, in the second flushing process (mid rim flushing/jet flushing process), while rim spouting of part W2 of the flush water W1 in the water supply channel 28 is continued, jet spouting is executed for spouting the remaining part W3 of the flush water W1 in the water supply channel 28 also from the jet spout port 10*a* via the jet water supply channel 32 and jet water supply passage 10; thereby allowing rim/jet spouting to be surely executed.

In this case, the branch part B1 for branching from the upstream side water supply channel 28 (first flow path) to the rim water supply channel 30 (second flow path) is located on the upstream side of the switching valve body 34. This allows the flow of the flush water W2 (rim spouting), which flows from the branch part B1 of the upstream side water supply channel 28 (first flow path) to the rim water supply channel 30 (second flow path), to be hardly affected by the operation of the switching valve body 34 in switching from the first flushing process (pre rim flushing process) to the second flushing process (mid rim flushing/jet flushing process) due to the operation of the switching valve body 34.

Thus, the rim spouting that is executed in each of the first flushing process (pre rim flushing process) and the second flushing process (mid rim flushing/jet flushing process), which is hardly affected by the operation of the switching valve body 34, can be stabilized while variations of the flow rate [L/min] suppressed.

It should be noted that although the aforementioned flush toilet 1 according to one embodiment of the present invention has been described by taking, as one example, the mode for executing both rim spouting and jet spouting in the second flushing process (mid rim flushing/jet flushing process) shown in FIG. 4, it is not limited to such a mode and it may be possible that only jet spouting is executed with rim spouting omitted in the second flushing process.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet flushed with pressurized flush water, comprising:

a flush water storage tank configured to store flush water;

a toilet main body including a bowl, a rim spout port and jet spout port configured to spout the flush water, and a discharge trap part;

a water supply channel configured to allow flush water to be supplied from the flush water storage tank to each of the rim spout port and the jet spout port;

a switching device provided on the water supply channel and configured to switch a water supply path for supplying flush water to each of the rim spout port and the jet spout port, the switching device switching the water supply path so as to first execute a first flushing process for spouting the flush water in the water supply channel from the rim spout port and then, execute a second flushing process for spouting the flush water in the water supply channel from at least the jet spout port; and a pressure pump configured to pressurize the flush water to be supplied from the flush water storage tank to the water supply channel, thereby allowing a flow rate of the flush water in the water supply channel to be adjusted, the pressure pump allowing such an adjustment that a second flow rate of the flush water to be pressure-fed in the second flushing process becomes higher than a first flow rate of the flush water to be pressure-fed in the first flushing process; wherein the switching device includes a switching valve body mechanically operating by receiving a water pressure of the flush water pressurized by the pressure pump, the switching valve body being configured to perform switching to a water supply path allowing the first flushing process or the second flushing process to be executed according to a different water pressure generated by the pressure pump, wherein the switching device switches the water supply path so that the first flushing process is first executed so as to spout the flush water in the water supply channel from the rim spout port and after that, the second flushing process is executed so as to spout the flush water also from the jet spout port while continuing spouting the flush water from the rim spout port.

2. The flush toilet according to claim 1, wherein the switching device includes:

a rim water supply passage provided on an upstream side of the switching valve body and configured to supply flush water to the rim spout port; and a jet water supply passage provided on a downstream side of the switching valve body and configured to supply flush water to the jet spout port.

3. The flush toilet according to claim 2, wherein the switching valve body of the switching device opens and closes only the jet water supply passage.

4. The flush toilet according to claim 3, wherein the switching valve body of the switching device is openably/closably provided at an upstream end of the jet water supply passage and is located above an upstream end of the rim water supply passage.

5. The flush toilet according to claim 4, wherein the switching valve body of the switching device is located above an overflow water level within the flush water storage tank.

6. The flush toilet according to claim 3, wherein the rim water supply passage is provided with a fixed flow valve.

7. The flush toilet according to claim 1, wherein the switching device further includes a bias part configured to bias the switching valve body in a valve closing direction, the switching valve body operating in a valve opening direction against the biasing force of the bias part when in a state of receiving a predetermined or higher water pressure.

8. The flush toilet according to claim 1, wherein the switching device further switches the water supply path so as to execute a third flushing process for spouting flush water from the rim spout port after the second flushing process, the spouting of flush water from the rim spout port being continued from the second flushing process; and the pressure pump allows such an adjustment that the third flow rate of the flush water to be pressure-fed in the third flushing process becomes lower than the second flow rate of the flush water to be pressure-fed in the second flushing process.

9. The flush toilet according to claim 1, wherein the switching device further includes:

a first flow path being supplied with the flush water from the pressure pump and extending to the switching valve body;

a second flow path branching from a branch part in the first flow path so as to supply flush water to the rim spout port; and a third flow path configured to supply flush water from the switching valve body to the jet spout port; and a first flow path cross-sectional area (A1) of the first flow path on an upstream side of the branch part is different from a second flow path cross-sectional area (A2) of the first flow path on a downstream side of the branch part.

10. The flush toilet according to claim 9, wherein the second flow path cross-sectional area (A2) is larger than the first flow path cross-sectional area (A1).

11. The flush toilet according to claim 9, wherein a third flow path cross-sectional area (A3) of the third flow path is larger than the second flow path cross-sectional area (A2) of the first flow path.

12. The flush toilet according to claim 1, wherein the switching device further includes:

a first flow path extending from the pressure pump to the switching valve body;

a second flow path branching from a branch part in the first flow path and extending to the rim spout port; and a third flow path extending from the switching valve body to the jet spout port; and the switching valve body is arranged at an opposing position on an axial direction of the first flow path.

13. The flush toilet according to claim 12, wherein a flow path cross-sectional area (A3) of the third flow path is larger than a flow path cross-sectional area (A2) of the first flow path.

14. The flush toilet according to claim 12, wherein a flow path cross-sectional area (A2) on a downstream side of the branch part in the first flow path is larger than a flow path cross-sectional area (A1) of the first flow path on an upstream side of the branch part.

* * * * *